US006694994B1

(12) United States Patent
Zheng

(10) Patent No.: US 6,694,994 B1
(45) Date of Patent: Feb. 24, 2004

(54) COLLAPSIBLE STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 09/536,738

(22) Filed: Mar. 28, 2000

(51) Int. Cl.[7] ..... E04H 15/40

(52) U.S. Cl. ..... 135/126; 135/128; 135/117; 473/471; 446/478; 446/487

(58) Field of Search ..... 135/125, 126, 135/124, 128, 137, 905, 906, 143, 147, 115; 473/471; 446/478, 487

(56) References Cited

U.S. PATENT DOCUMENTS

| | | | | | |
|---|---|---|---|---|---|
| 3,990,463 | A | * | 11/1976 | Norman | 135/126 |
| 4,825,892 | A | | 5/1989 | Norman | |
| 4,858,634 | A | | 8/1989 | McLeese | |
| 5,038,812 | A | | 8/1991 | Norman | |
| 5,301,705 | A | * | 4/1994 | Zheng | 135/125 |
| 5,396,917 | A | * | 3/1995 | Hazinski et al. | 135/128 X |
| 5,439,017 | A | * | 8/1995 | Brown | 135/126 |
| 5,467,794 | A | | 11/1995 | Zheng | |
| 5,645,096 | A | * | 7/1997 | Hazinski et al. | 135/126 |
| 5,722,446 | A | | 3/1998 | Zheng | |
| 5,778,915 | A | | 7/1998 | Zheng | |
| 5,800,067 | A | * | 9/1998 | Easter | 135/126 X |
| 5,816,278 | A | * | 10/1998 | Kim | 135/126 |
| 5,816,954 | A | | 10/1998 | Zheng | |
| D400,949 | S | * | 11/1998 | Gale | D21/837 |
| D412,354 | S | * | 7/1999 | Takos | D21/837 |
| 5,964,533 | A | | 10/1999 | Ziglar | |
| 5,971,188 | A | | 10/1999 | Kellogg et al. | |
| 5,975,101 | A | | 11/1999 | Zheng | |
| 6,006,772 | A | | 12/1999 | Zheng | |
| 6,109,281 | A | * | 8/2000 | Lowenthal | 135/125 |
| 6,216,716 | B1 | * | 4/2001 | Gobel | 135/126 |
| 6,302,127 | B1 | * | 10/2001 | Gayton | 135/124 |

FOREIGN PATENT DOCUMENTS

| | | | | |
|---|---|---|---|---|
| FR | 2635-136 | * | 9/1990 | 125/126 |
| JP | 3-21779 | * | 1/1991 | 135/25 |

* cited by examiner

*Primary Examiner*—Winnie S. Yip
(74) *Attorney, Agent, or Firm*—Raymond Sun

(57) ABSTRACT

Collapsible structures include one or more add-on panels chat are coupled to the underlying collapsible structure to improve the variety of play, entertainment value, and utility of these collapsible structures. Each of these collapsible structures incorporate at least one foldable frame member, and fabric covering portions of the frame member. The collapsible structures can be collapsed into a smaller configuration by twisting and folding the at least one frame member.

9 Claims, 31 Drawing Sheets

COLLAPSIBLE STRUCTURES

BACKGROUND OF THE INVENTION

1. Field of the Invention

The present invention relates to collapsible structures, and in particular, to modifications and additions to currently-known collapsible structures to enhance the utility and variety of use for these collapsible structures.

2. Description of the Prior Art

There are presently many collapsible structures that are being provided for use by children and adults. Examples of these collapsible structures are illustrated in the following patents: U.S. Pat. No. 5,816,954 (Zheng), U.S. Pat. No. 6,006,772 (Zheng), U.S. Pat. No. 5,778,915 (Zheng), U.S. Pat. No. 5,467,794 (Zheng), U.S. Pat. No. 5,975,101 (Zheng), U.S. Pat. No. 5,722,446 (Zheng), U.S. Pat. No. 4,858,634 (McLeese), U.S. Pat. No. 4,825,592 (Norman), U.S. Pat. No. 5,964,533 (Ziglar), U.S. Pat. No. 5,971,188 (Kellogg et al.), and U.S. Pat. No. 5,038,812 (Norman), among others. These collapsible structures are supported by one or more frame members that can be twisted and folded to reduce the overall size of the structure. These collapsible structures can be used in a wide variety of applications, such as containers, tents, play structures, executive toys, shelters, sports structures, and others. As a result, collapsible structures have become very popular.

Even though these collapsible structures exhibit surprising versatility in their utility and wide-ranging applications, the consumer is always demanding greater enhancements, better and more features, added convenience, and other related factors. Thus, there remains a need to provide collapsible structures that have increased variety of play, entertainment value, and utility.

SUMMARY OF THE DISCLOSURE

The present invention provides collapsible structures that provide additional panels and other features to known collapsible structures in order to improve the variety of plan, entertainment value, and utility of these collapsible structures. These collapsible structures can be easily and quickly folded and collapsed into a compact configuration.

In order to accomplish the objects of the present invention, the collapsible structures according to the present invention include one or more add-on panels that are coupled to the underlying collapsible structure to improve the variety of play, entertainment value, and utility of these collapsible structures.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 32:
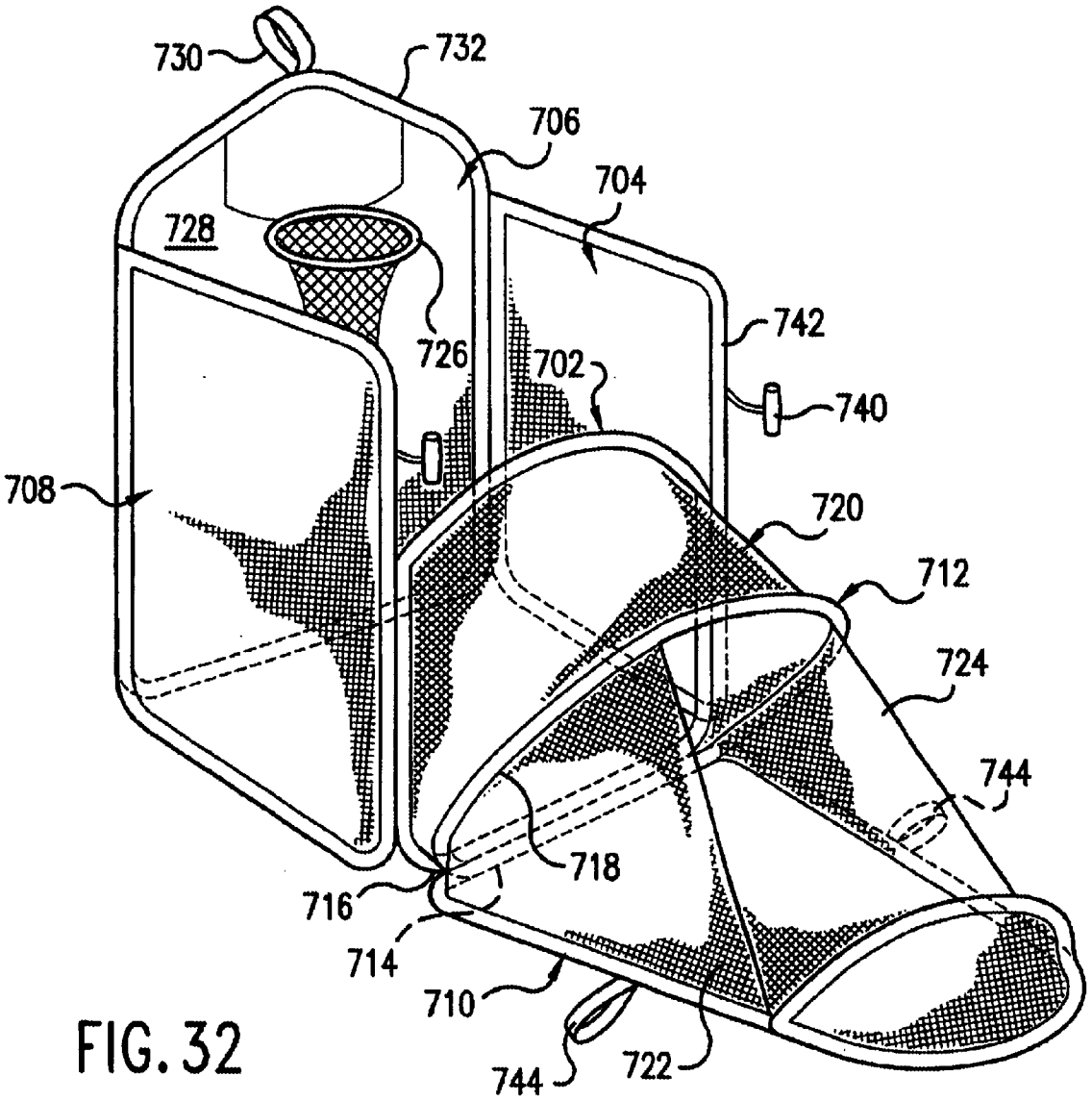
FIG. 32 is a perspective view of a collapsible structure according to yet another embodiment of the present invention.

The present invention provides collapsible structures that provide additional panels and other features to known collapsible structures in order to improve the variety of play, entertainment value, and utility of these collapsible structures. As used herein, the terms "hingedly coupled" or "hingedly connected" mean to couple two edges by stitching or by the use of removable attachment mechanisms, such as Velcro™ pads or opposing toggles and loops (as illustrated in FIG. 32). In addition, the term "add-on panel" means a panel that is not needed to form the basic underlying structure of a collapsible structure (i.e., not needed to provide basic support and stability to the collapsible structure), and which is provided to be an addition to the basic underlying structure to enhance the aesthetics, utility, amusement, play or variety of the basic underlying structure, or to add features to the basic underlying structure. In addition, all add-on panels as described herein can have the same construction as any of the panels 22 in FIG. 1, except that the shapes and sizes may be varied as desired.

Figure 1:
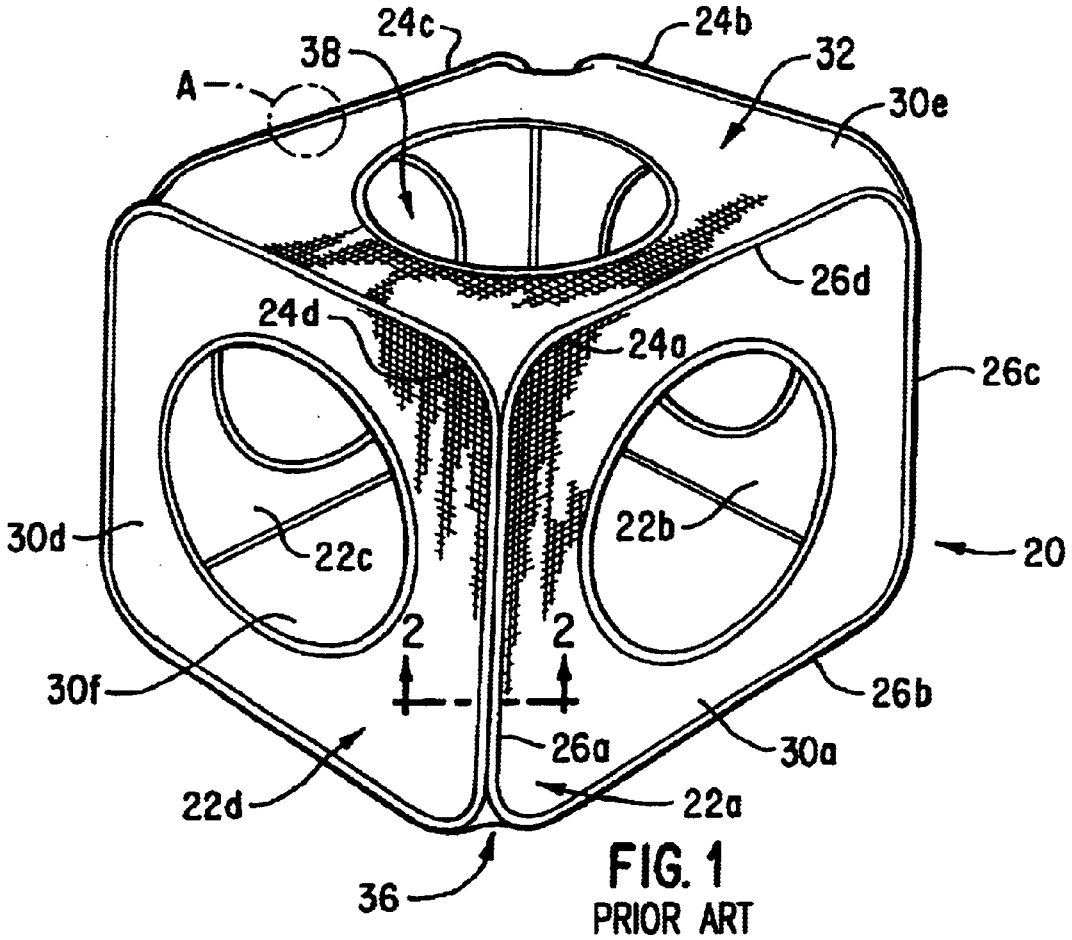
FIG. 1 PRIOR ART
FIG. 1 is a perspective view of a conventional collapsible structure.

FIG. 1 illustrates a collapsible structure 20 that is made up of a plurality of panels that are hingedly coupled together.

Figure 1A:
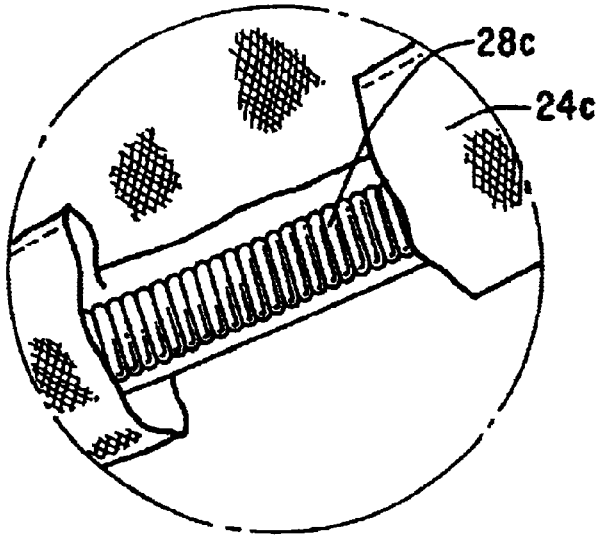
FIG. 1A PRIOR ART
FIG. 1A is a partial cut-away view of the section A of she structure of FIG. 1 illustrating a frame member retained within a sleeve.

FIG. 1 corresponds to FIG. 1 of U.S. Pat. No. 6,006,772, whose entire disclosure is hereby incorporated by this reference as though fully set forth herein. The structure 20 has four panels 22*a*, 22*b*, 22*c* and 22*d* connected to each other to encircle an enclosed space. Each side panel 22*a*, 22*b*, 22*c* and 22*d* has four sides, a left side 26*a*, a bottom side 26*b*, a right side 26*c* and a top side 26*d*. Each side panel 22*a*, 22*b*, 22*c* and 22*d* has a continuous frame retaining sleeve 24*a*, 24*b*, 24*c* or 24*d* provided along and traversing the four edges of its four sides 26*a*, 26*b*, 26*c* and 26*d*. A continuous frame member 28*a*, 28*b*, 28*c* or 28*d* is retained or held within each frame retaining sleeve 24*a*, 24*b*, 24*c* or 24*d*, respectively, to support each side panel 22*a*, 22*b*, 22*c* and 22*d*. Only the frame member 28*c* is shown in FIG. 1A; the other frame members 28*a*, 28*b* and 28*d* are not shown but are the same as frame member 28*c*.

The continuous frame members 28*a*, 28*b*, 28*c* and 28*d* may be provided as one continuous loop, or may comprise a strip of material connected at both ends to form a continuous loop. The continuous frame members 28*a*, 28*b*, 28*c* and 28*d* are preferably formed of flexible coilable steel, although other materials such as plastics may also be used. The frame members should be made of a material which is relatively strong and yet is flexible to a sufficient degree to allow it to be coiled. The material should have a memory that allows the frame members to spring back to the expanded position when unfolded from the folded position. Thus, each frame member 28*a*, 28*b*, 28*c* and 28*d* is capable of assuming two positions or orientations, an open or expanded position such as shown in FIG. 1, or a folded position in which the frame member is collapsed into a size which is much smaller than its open position.

Fabric or sheet material 30*a*, 30*b*, 30*c* and 30*d* extends across each side panel 22*a*, 22*b*, 22*c* and 22*d*, respectively, and is held taut by the respective frame members 28*a*, 28*b*, 28*c* and 28*d* when in its open position. The term fabric is to be given its broadest meaning and should be made from strong, lightweight materials and may include woven fabrics, sheet fabrics or even films. The fabric should be water-resistant and durable to withstand the wear and tear associated with rough treatment by children. The frame members 28*a*, 28*b*, 28*c* and 28*d* may be merely retained within the respective frame retaining sleeves 24*a*, 24*b*, 24*c* and 24*c* without being connected thereto. Alternatively, the frame retaining sleeves 24*a*, 24*b*, 24*c* and 24*d* may be mechanically fastened, stitched, fused, or glued to the frame members 28*a*, 28*b*, 28*c* and 28*d*, respectively, to retain them in position.

Figure 5A:
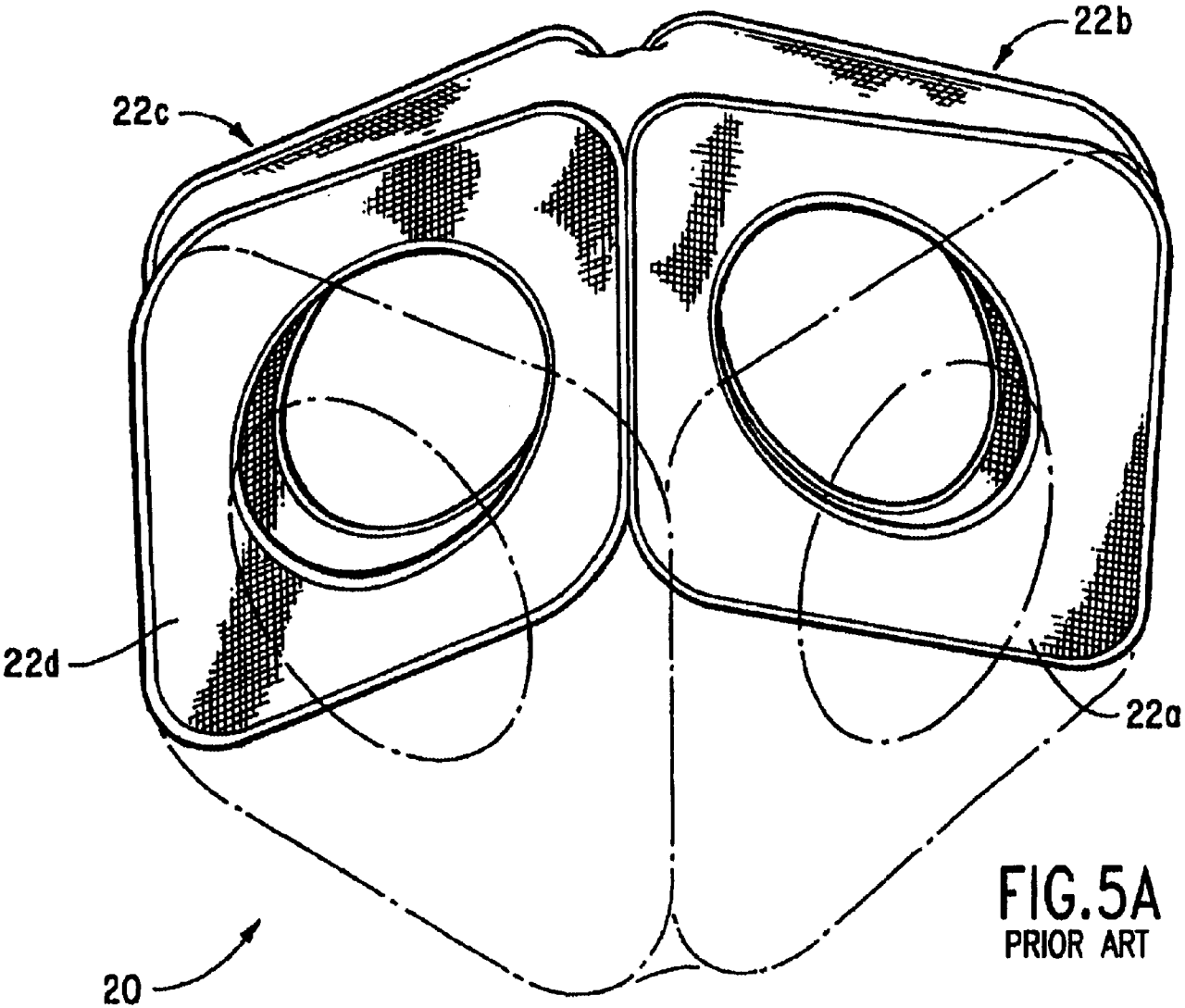
FIG.5A PRIOR ART
FIGS. 5(A) through 5(E) illustrate how the collapsible structure of FIG. 1 may be twisted and folded for compact storage.
Figure 5B:
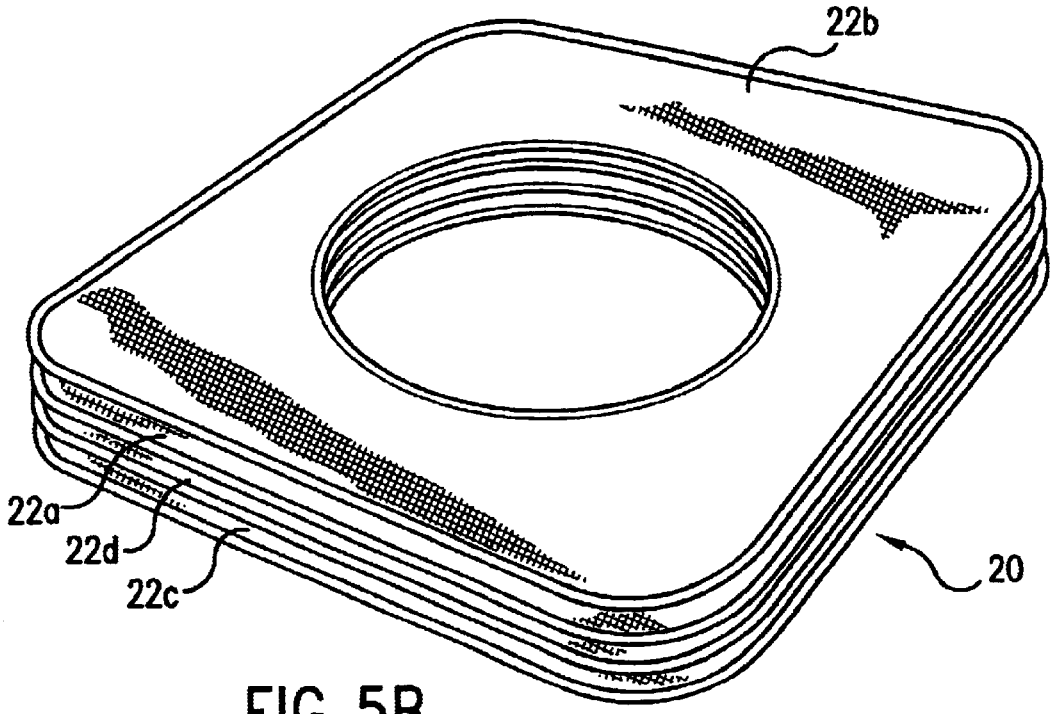
FIG. 5B PRIOR ART
Figure 5C:
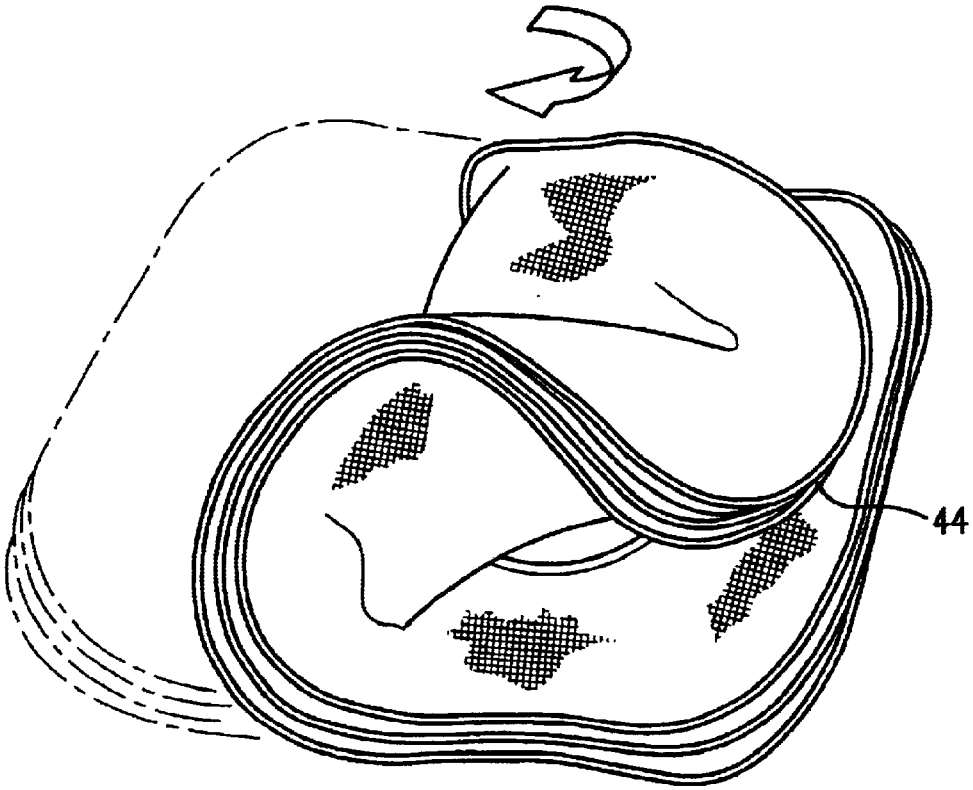
FIG. 5C PRIOR ART
Figure 8:
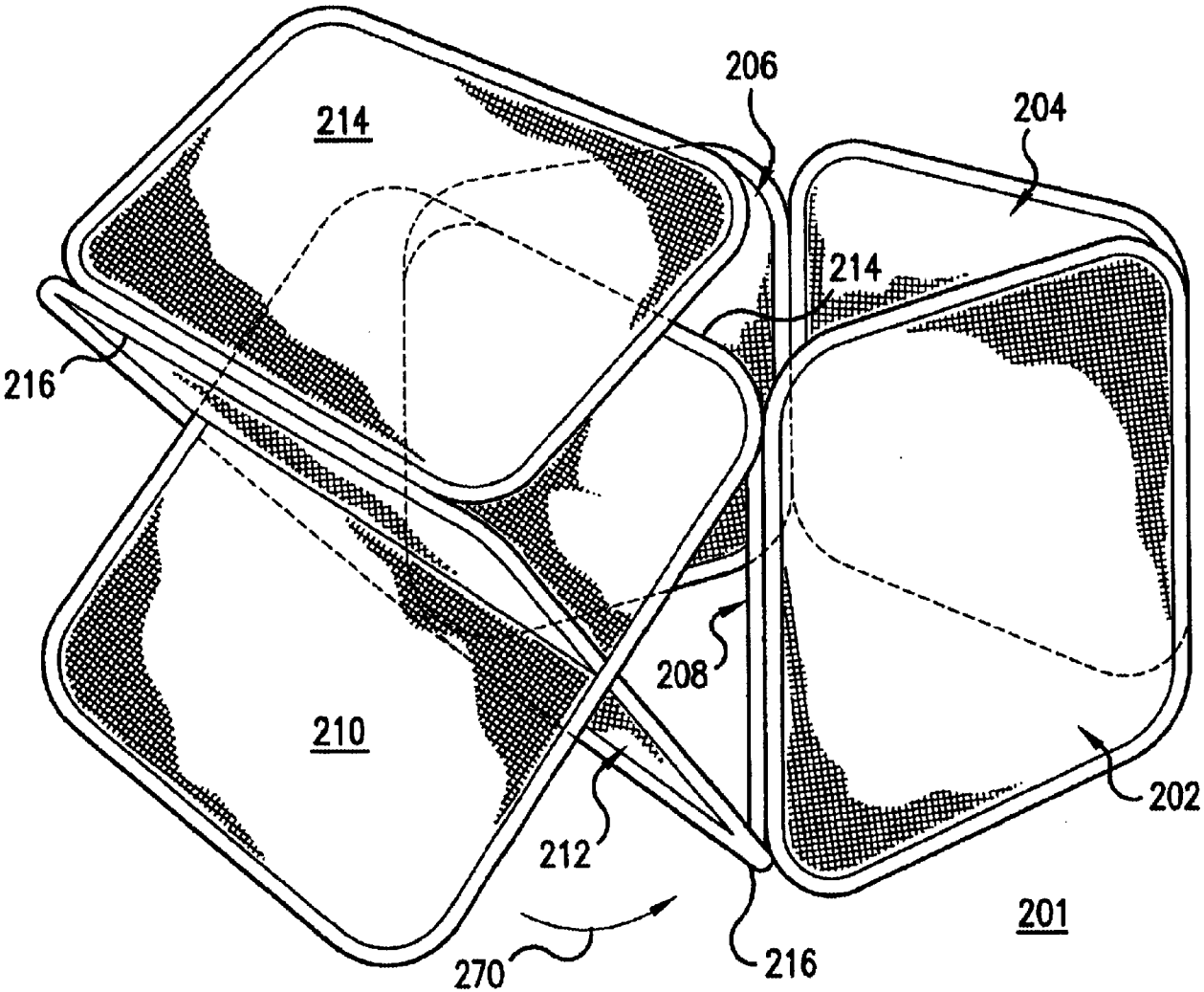

The other details relating to the structure 20 are set forth in greater detail in the specification and drawings of U.S. Pat. No. 6,006,772, and shall not be repeated herein. However, FIGS. 5(A) through 5(E) correspond to FIGS. 8 (A) through 8 (E) of U.S. Pat. No. 6,006,772, and illustrate how the structure 20 can be twisted and folded to reduce the structure 20 into a collapsed configuration having a reduced size. In FIG. 5(A), the first step consists of pushing in panels 22*a*and 22*d* such that panel 22*d* collapses upon panel 22*c* and panel 22*a*collapses upon panel 22*b*. Then, in the second step shown in FIG. 8B, the two panels 22*a* and 22*b* are folded so as to be collapsed upon the two panels 22*c* and 22*d*. The structure is then twisted and folded to collapse the frame members and side panels into a smaller shape. In the third step shown in FIG. 8C, the opposite border 44 of the structure is folded in upon the previous fold to further collapse the frame members with the panels. As shown in FIG. 8D, the fourth step is to continue the collapsing so that the initial size of the structure is reduced. FIG. 8E shows the fifth step with the frame members and panels collapsed on each other to provide for a small essentially compact configuration having a plurality of concentric frame members and layers of the side panels so that the collapsed structure has a size which is a fraction of the size of the initial structure.

Figure 2:
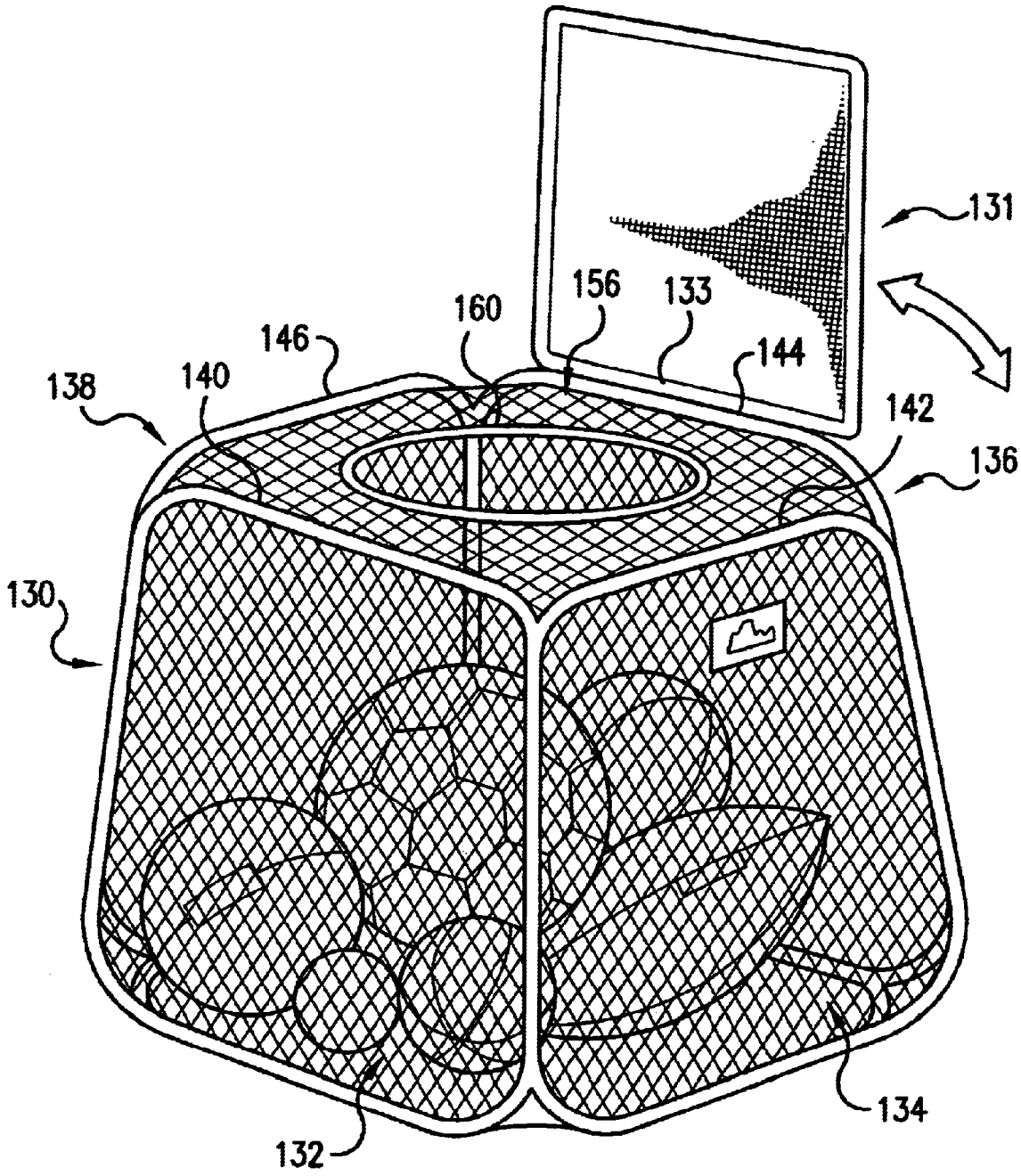
FIG. 2 is a perspective view of a collapsible structure according to one embodiment of the present invention.

The structure 20 has many uses, including as a play structure and shelter, among others, and can even be used as a container, as illustrated in some of the embodiments of U.S. Pat. No. 6,006,772. In this regard, FIG. 2 illustrates the structure 130 of FIG. 9 in U.S. Pat. No. 6,006,772, except that an additional (i.e., add-on) panel 131 has been hingedly coupled to the upper edge 144 of one panel 136 to act as a lid, for example. In particular, the structure 130 in FIG. 2 is similar to structure 20, and has four panels 132, 134, 136 and 138. Panels 132, 134, 136 and 138 have essentially the same structure and construction, and are hingedly connected to each other in the same manner, as the panels 22*a*, 22*b*, 22*c* and 22*d* of structure 20. As with structure 20, an upper fabric 156 is connected to the upper edges 140, 142, 144, 146 of each panel 132, 134, 136, 138, respectively. The panel 131 has an edge 133 that is hingedly coupled to the upper edge 144 of the panel 136. The panel 131 can be pivoted about its hinged connection at the edges 133 and 144 to an opened position where the panel 131 is adjacent the panel 136, and to a closed position where the panel 131 is positioned on top of the fabric 156 and covering the opening 160.

Figure 3:
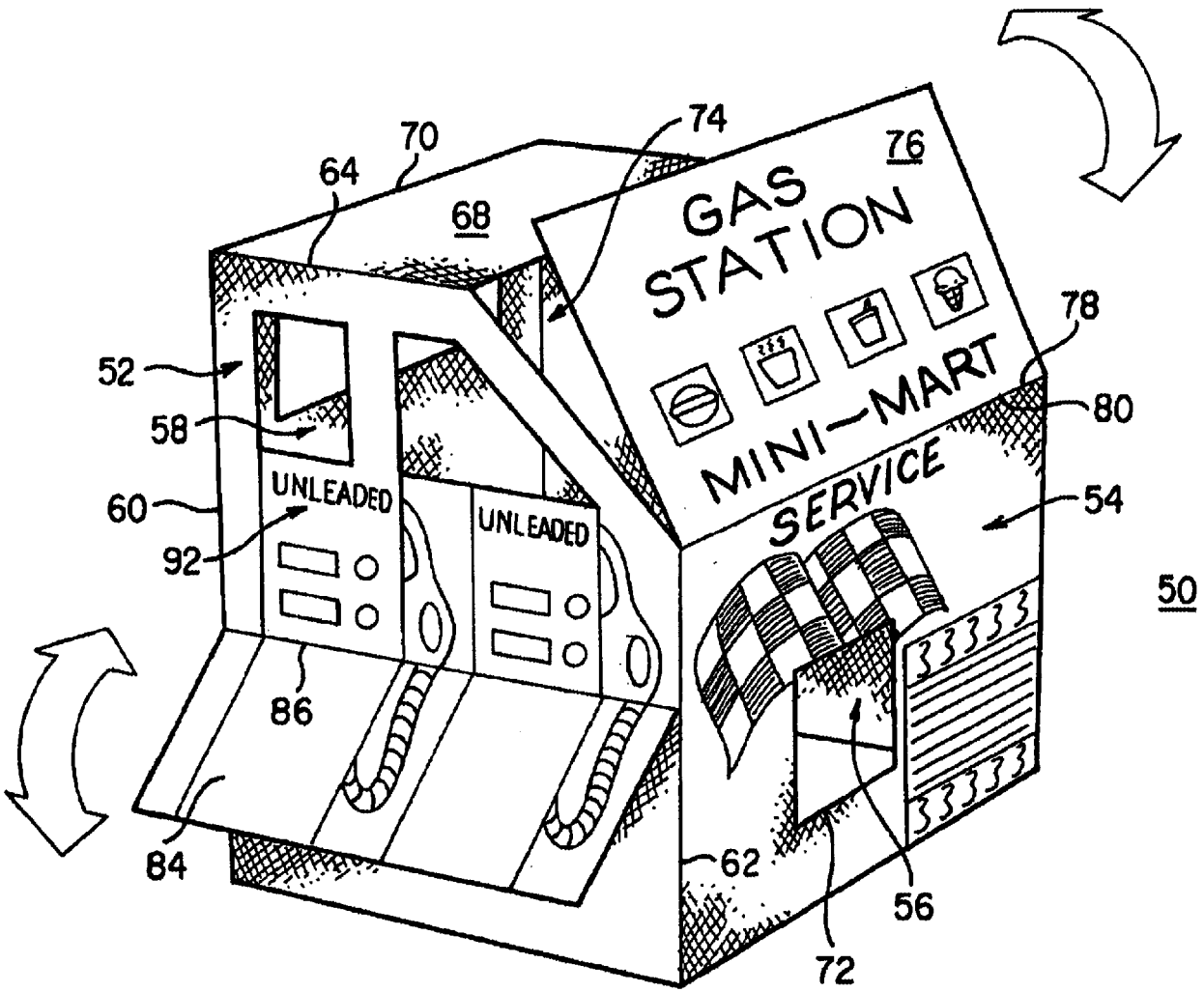
FIGS. 3 and 4 are perspective views of a collapsible structure according to another embodiment of the present invention.
Figure 4:
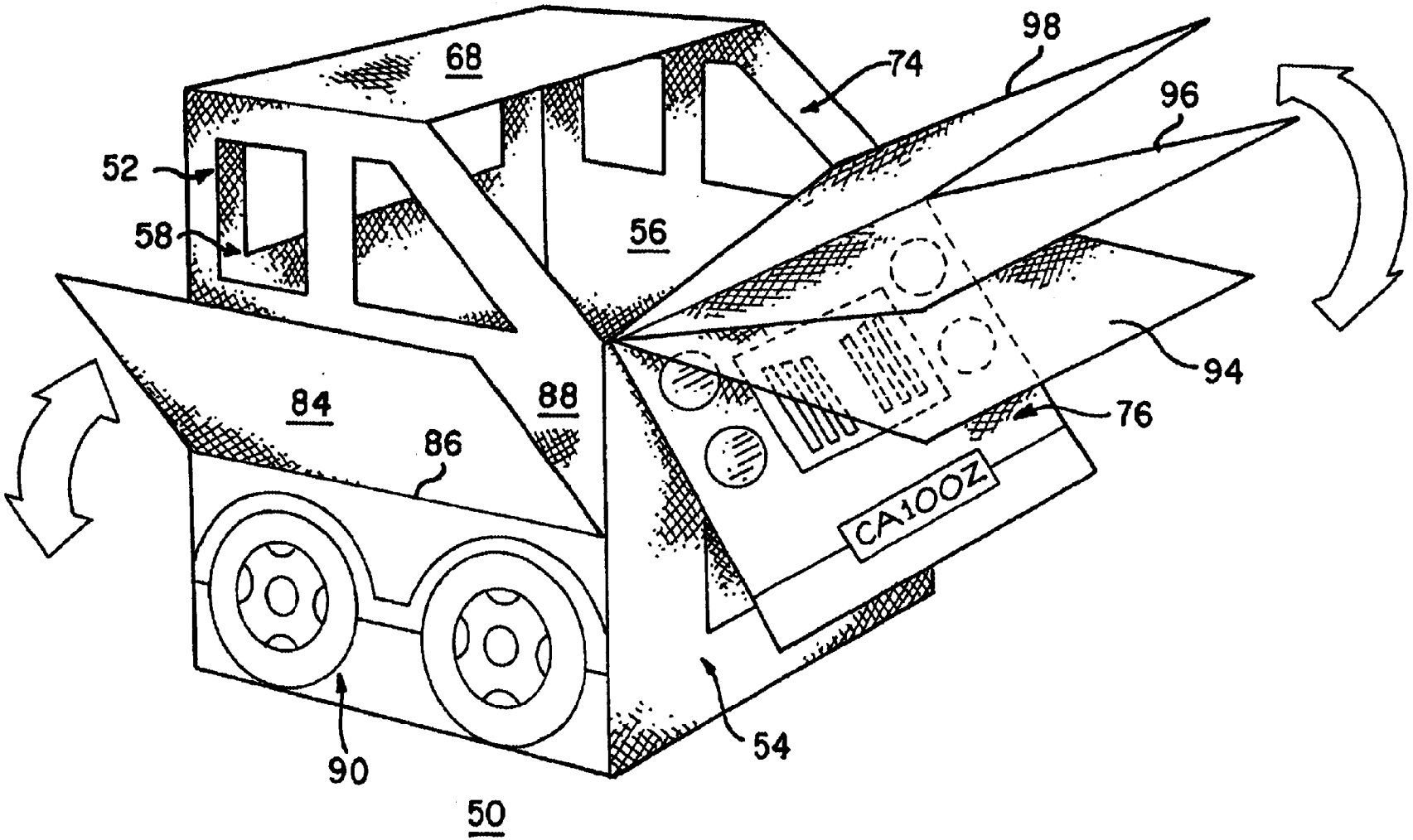

FIGS. 3 and 4 illustrate how the principles illustrated in FIG. 2 can be extended to create play structures having increased play variety. The structure 50 in FIGS. 3 and 4 has four panels 52, 54, 56 and 58 that have essentially the same structure and construction, and are hingedly connected to each other in the same manner, as the panels 22*a*, 22*b*, 22*c* and 22*d* of structure 20. The only difference is that the shapes of the panels 52 and 56 are slightly different in that their two sides 60 and 62 have different lengths, and the upper side has a horizontal section 64 and an angled section 66. In addition, the panel 54 is shorter in height than the panel 58. A fabric roof 68 can extend across the upper side 70 of the panel 58, and the section 64 of the panels 52 and 56 to partially cover the structure 50, leaving an open uncovered space 74. These modifications result in a structure 50 that can be configured to resemble a gas station (see FIG. 3) or a vehicle (see FIG. 4). An opening 72 can be provided in the panel 54 to allow access to and from the interior of the structure 50.

A first add-on panel 76 has an edge 78 that is hingedly coupled to the upper edge 80 of the panel 54. The panel 76 can be pivoted about its hinged connection at the edges 78 and 80 to either cover the space 74 (which can be sized and configured to be similar to the size and shape of the panel 76), or to a position where the panel 76 is adjacent the panel 54 to cover the opening 72. Both sides of the panel 76 can be provided with different designs and indicia to fit the theme of the structure 50. For example, one side of the panel 76 can have the words "GAS STATION" and "MINI MART" (as shown in FIG. 3) exhibited when the panel 76 covers the space 74, so that children can "enter" the mini mart via opening 72. The other side of the panel 76 can be decorated to look like the front of a vehicle (see FIG. 4) when the panel 76 is adjacent the panel 54, with the open space 74 functioning as an open windshield.

A second add-on panel 84 has an edge 86 that is hingedly coupled to the fabric 88 of the panel 52. The panel 84 can be pivoted about its hinged connection at the edge 86 and the fabric 88 to either cover a lower portion 90 of the panel 52 or an upper portion 92 of the panel 52. The lower portion 90 can include depictions of two wheels, and the upper portion 92 can include depictions of two gasoline machines. Thus, when the panel 84 covers the lower portion 90 (see FIG. 3), and if the other add-on panel 76 covers the space 74, then the structure 50 can be a combined gasoline station and mini-mart. In this regard, one side of the panel 84 can be decorated with gas pump designs so that it will match (i.e., form a part of) the designs in the upper portion 92 of the panel 52. On the other hand, when the panel 84 covers the upper portion 92 (see FIG. 4), and if the other add-on panel 76 is adjacent the panel 54, then the structure 50 can be a vehicle. As a result, by providing one or more "add-on" panels 76 and 84 that are hingedly coupled to selected portions of certain panels of the underlying structure 50, the structure 50 can be made into two different objects, thereby increasing the amusement and play value. The add-on panels 76 and 84 can have the same construction as any of the panels 22 in FIG. 1.

As shown in FIG. 4, it is also possible to provide additional add-on panels 94, 96, 98 at the same location of the hanged coupling between the upper edge 80 of the panel 54 and the edge 78 of the first add-on panel 76. Each of these panels 94, 96, 98 can be hingedly coupled to the upper edge 80 of the panel 54, and both sides of each of these panels 94, 96, 98 can also be decorated with different designs and indicia, so that each panel 76, 94, 96 and 98 can represent different themes. As a result, the user will be able to select the desired theme(s) depending on the panels 76, 94, 96 and 98 deployed, thereby increasing the play variety and amusement value of the structure 50.

The structure 50 can be folded and collapsed by first folding the panels 76, 94, 96 and 98 against the panel 54 to create a stack of five panels 54, 76, 94, 96, 98 (in this order), and then folding the panel 84 in either direction against the panel 52 to provide a four-sided structure similar to structure 20. The four-sided structure 50 can then be folded and collapsed using the steps illustrated in FIGS. 5(A) through 5(E).

Figure 5D:
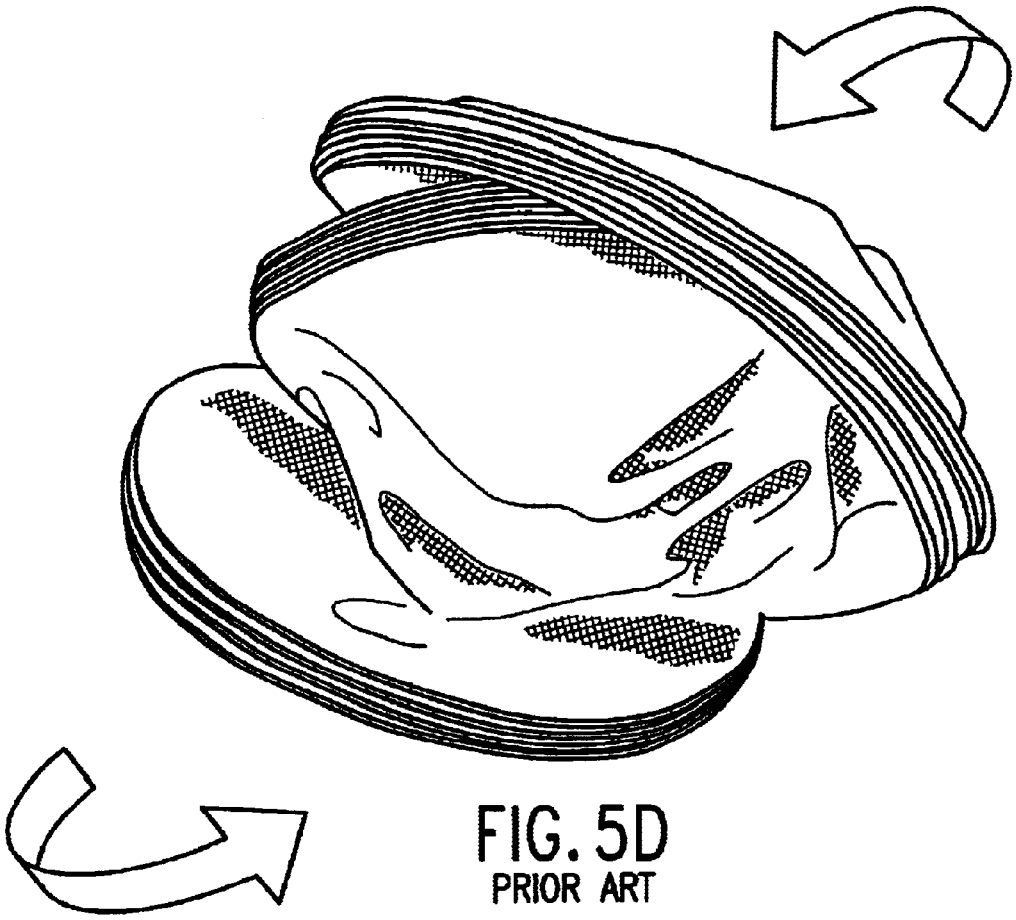
FIG. 5D PRIOR ART
Figure 5E:
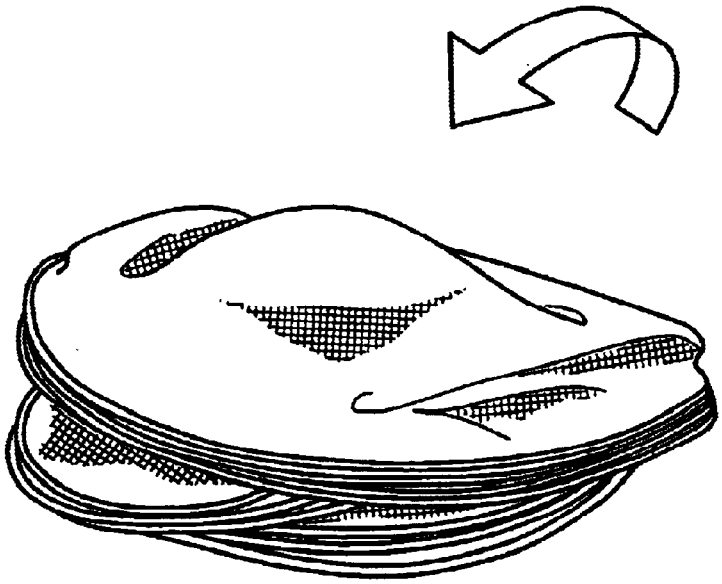
FIG. 5E PRIOR ART
Figure 6:
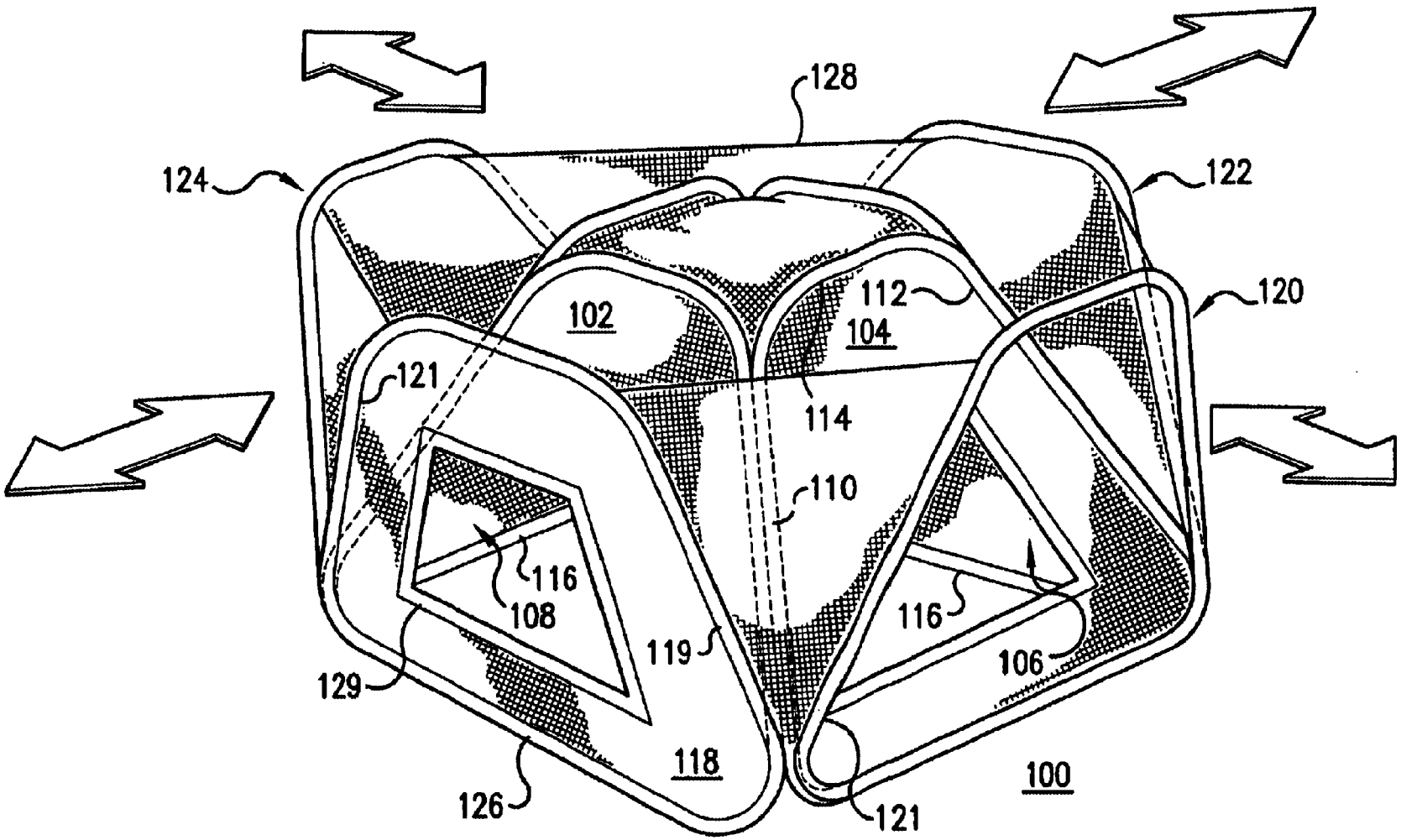
FIGS. 6–8 are perspective views of collapsible structures according to other embodiments of the present invention.

FIG. 6 illustrates another structure 100 that has four panels 102, 104, 106 and 108 that have essentially the same structure and construction, and are hingedly connected to each other in the same manner, as the panels 22*a*, 22*b*, 22*c* and 22*d* of structure 20. The only difference is that the panels 102, 104, 106, 108 are shaped differently, having angled side edges 110 and 112, and with the upper edge 114 being shorter than the lower edge 116. Four add-on panels 118, 120, 122, 124 are hinged coupled at their respective lower edges 126 to the lower edges 116 of the panels 102, 104, 106, 108. Each of the add-on panels 118, 120, 122, 124 can have generally the same configuration and size as the panels 102, 104, 106, 108. Additional fabric 128 can be stitched to the sides 119 and 121 of adjacent add-on panels 118, 120, 122, 124 to create an enclosure that is defined by the add-on panels 118, 120, 122, 124. In addition, each add-on panel 118, 120, 122, 124 can De provided with an opening 129 to provide access to the interior defined by the panels 102, 104, 106, 108, 118, 120, 122, 124. The structure 100 can be folded and collapsed by first folding the panels 118, 120, 122, 124 against the panels 102, 104, 106, 108, respectively, and then folding and collapsing using the steps illustrated in FIGS. 5(A) through 5(E).

Figure 7:
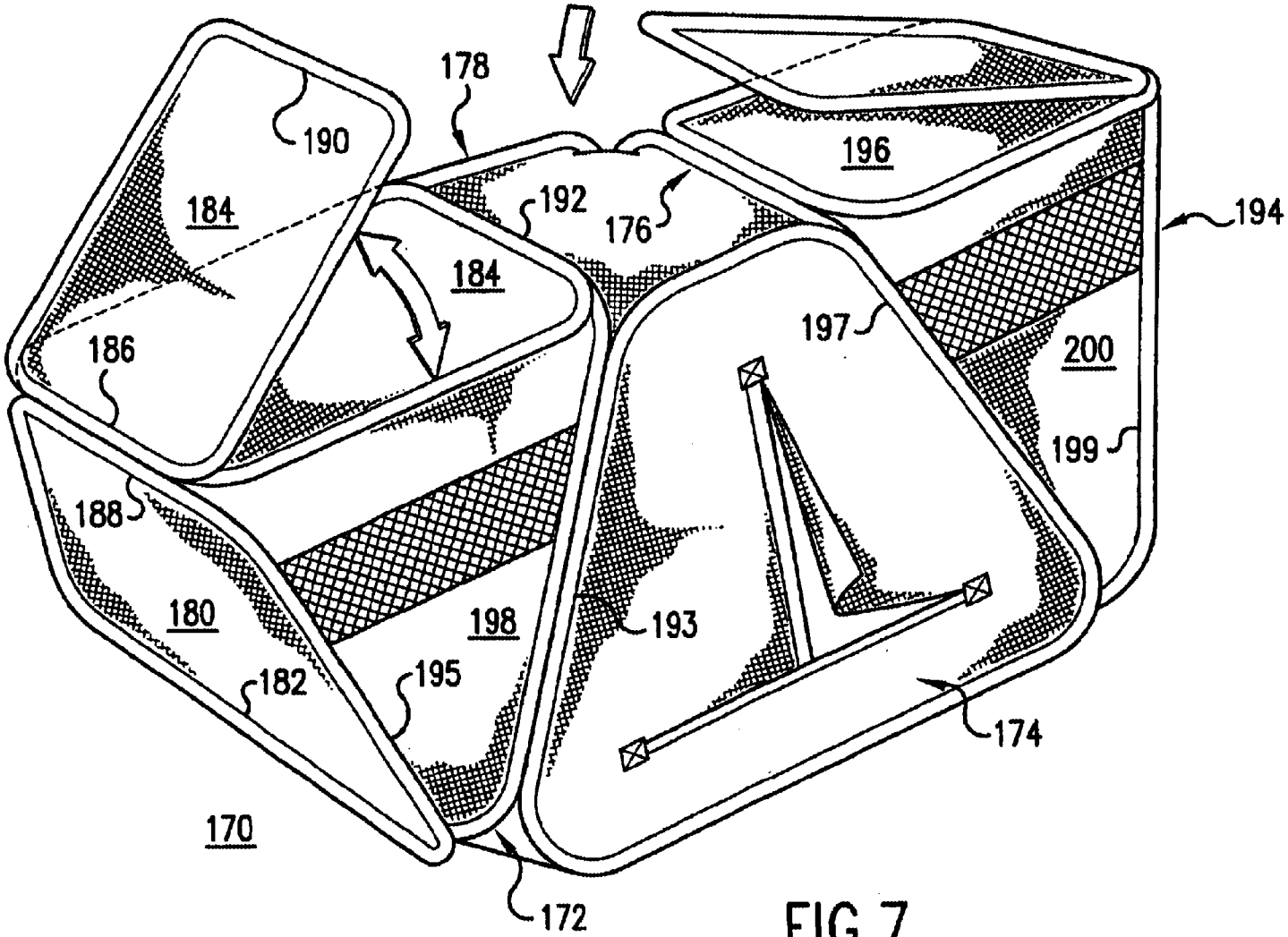

FIG. 7 illustrates modifications that can be made to the structure 100. The structure 170 in FIG. 7 has four panels 172, 174, 176 and 178 that can be the same as panels 102, 104, 106, 108, and which are hingedly connected to each other in the same manner. Instead of one add-on panel (e.g., 118, 120, 122, 124) for each panel 172, 174, 176 and 178 of the structure 170, the panels 172 and 176 can be provided without any fabric, but each is hingedly coupled to a pair of add-on panels. For example, a first add-on panel 180 has a lower edge 182 that is hingedly coupled to the lower edge of the panel 172, and a second add-on panel 184 has a lower edge 186 that is hingedly coupled to the upper edge 188 of the panel 180. The upper edge 190 of the second add-on panel 184 is removably attached (e.g., by Velcro™ pads) to the upper edge 192 of the panel 172. Add-on panels 194 and 196 that are similar to add-on panels 180 and 184, respectively, can be hingedly coupled to the opposing panel 176 using the same connections as for panels 180 and 184. Side fabric 198 can be stitched to the sides (e.g., 193 and 195) of the panels 172, 180 to form a left extension to the internal space defined by the panels 172, 174, 176, 178, and side fabric 200 can be stitched to the sides (e.g., 197 and 199) of the panels 176, 194 to form a right extension to the internal space defined by the panels 172, 174, 176, 178. The second add-on panels 184 and 196 can be detached from the panels 172 and 176, respectively, and then folded against the first add-on panels 180 and 194, respectively, and then each stack of add-on panels 180+184 and 194+196 can be folded against the panels 172 and 176, respectively. At this point, the structure 170 will resemble a four-sided structure that can be folded and collapsed using the same steps illustrated in FIGS. 5(A) through 5(E), or the four-sided structure 170 may be used in this configuration. In any case, the add-on panels 180+184 and 194+196 provide the user with the option to change the configuration and internal size of the base structure 170.

FIG. 8 illustrates another structure 201 having four panels 202, 204, 206, 208 that have essentially the same structure and construction, and are hingedly connected to each other in the same manner, as the panels 22*a*, 22*b*, 22*c* and 22*d* of structure 20. The panel 208 can be provided without any fabric material, but has two crossing or overlapping add-on panels 210 and 212 hingedly coupled to its upper edge 214 and its lower edge 216, respectively. The construction of the overlapping add-on panels 210 and 212 is illustrated in greater detail in FIGS. 9 and 10, which correspond to FIGS. 1A and 3, respectively, of U.S. Pat. No. 5,975,101, whose entire disclosure is hereby incorporated by this reference as though fully set forth herein.

Figure 9:
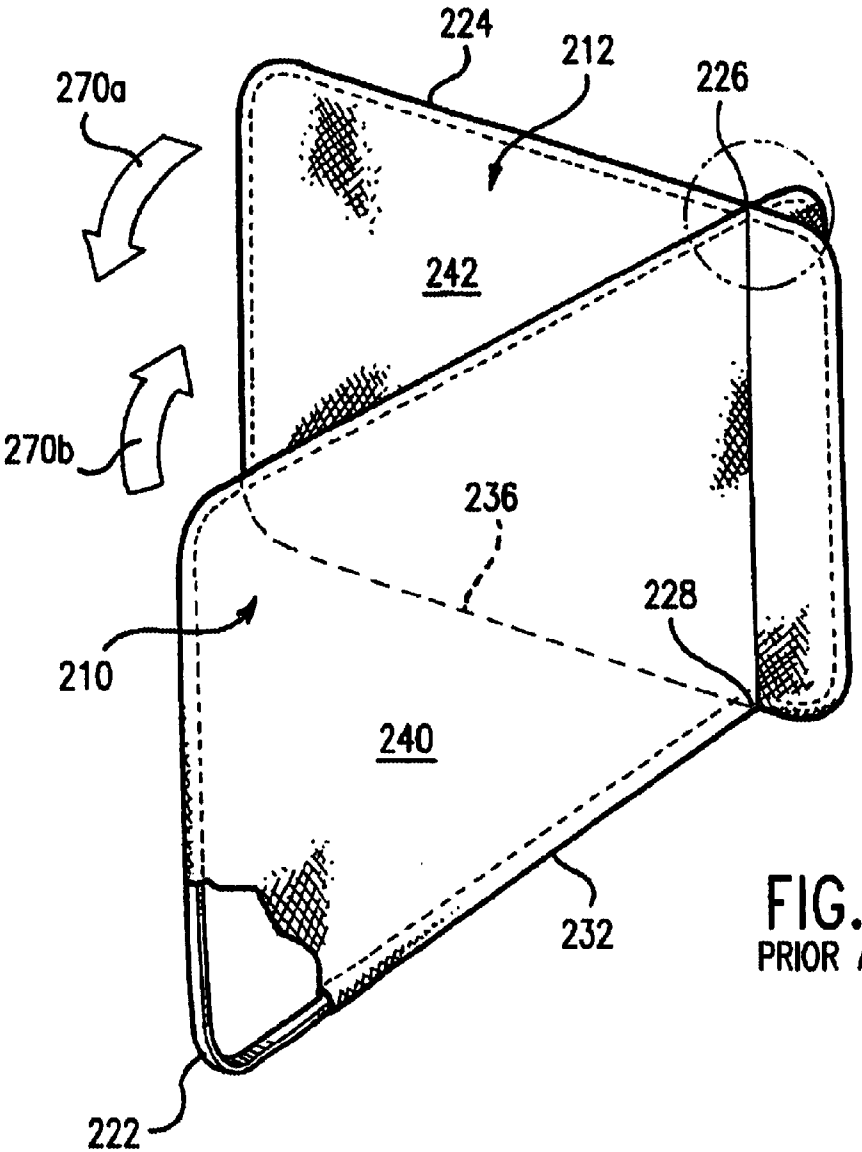
FIG. 9 PRIOR ART
FIGS. 9 and 10 illustrate the construction of the overlapping panels in FIG. 8.
Figure 10:
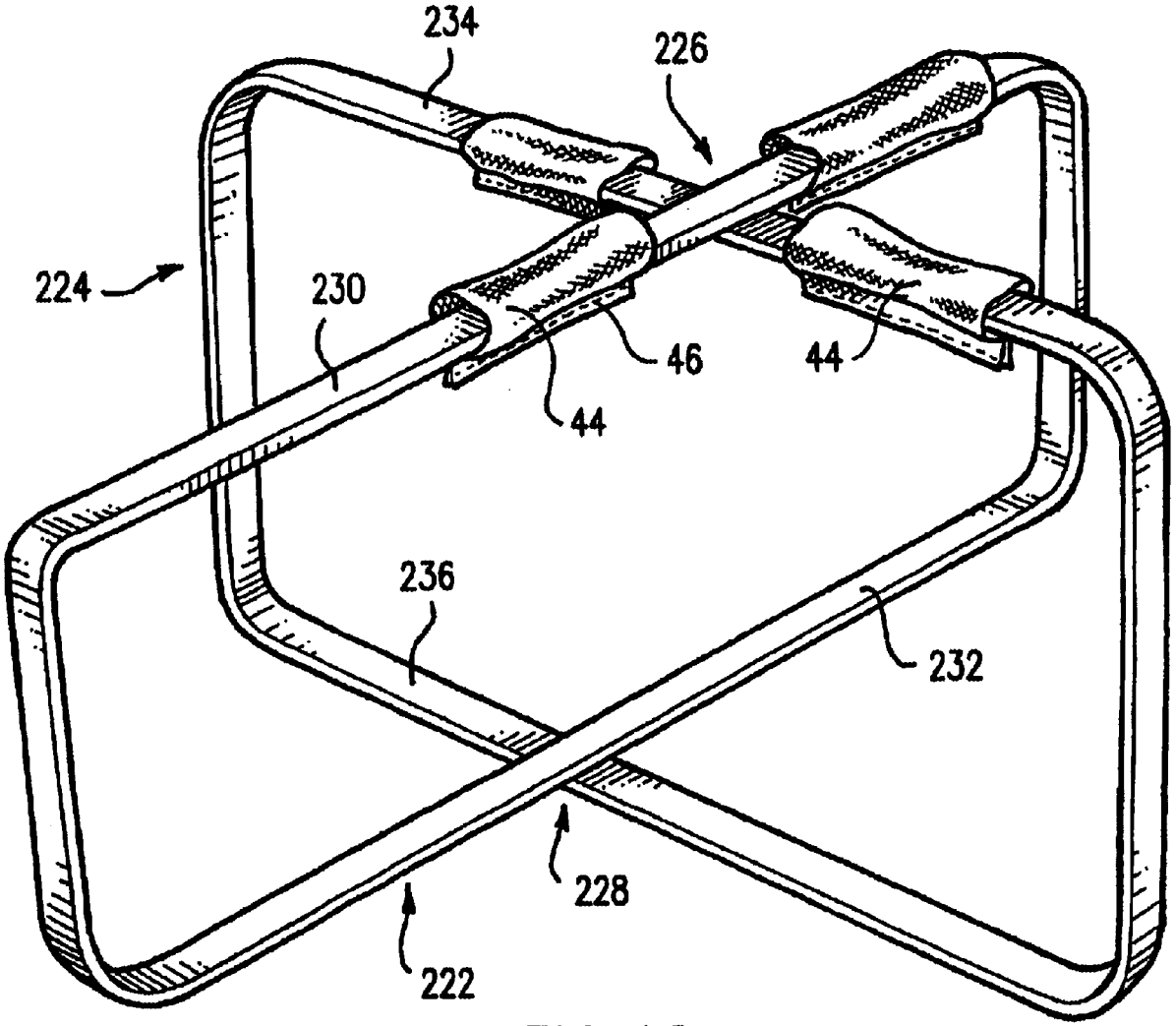
FIG. 10 PRIOR ART

In particular, each add-on panel 210 and 212 is defined by a separate resilient frame members 222 and 224, respectively, that together define the outer boundary of the overlapping panels 210, 212. Each frame member 222 and 224 can be the same as the frame member 28*c* in FIGS. 1 and 1A, and are fitted within each other, and overlap or cross-over each other at overlapping points 226 and-228. The overlapping point 226 is defined by the intersection or crossing of the upper edges 230 and 234 of frame members 222 and 224, respectively, and the overlapping point 228 is defined by the intersection or crossing of the lower edges 232 and 236 of frame members 222 and 224, respectively. The overlapping points 226 and 228 can be positioned anywhere along the upper edge 230 or lower edge 232 of the frame member 222, and anywhere along the upper edge 234 or lower edge 236 of the frame member 224. The two overlapping frame members 222 and 224 are pivotable about their overlapping points 226 and 228 between two positions, a first completely open position in which both frame members 222 and 224 lie flat in about the same plane, and a second folded position in which the frame members 222 and 224 are folded towards each other (such as in the direction of arrows 270*a* and 270*b* in FIG. 9) to overlie each other. Each frame member 222 and 224 is retained in a loop retaining portion of one or more fabric pieces. For example, as shown in FIG. 9, two fabric pieces 240 and 242 are provided, one for each frame member 222 and 224, respectively. Each fabric piece 240 and 242 covers (either partially or completely) and forms a panel 210 or 212 within the respective frame member 222 or 224, and is preferably held in tension with the frame member 222 or 224.

The other details relating to the overlapping panels 210 and 212 are set forth in greater detail in the specification and drawings of U.S. Pat. No. 5,975,101, and shall not be repeated herein.

Referring back to FIG. 8, the overlapping panels 210, 212 can be collapsed against each other in the direction of arrow 270 (which is the same direction as arrows 270*a* and 270*b*) to form a stack of collapsed overlapping panels 210, 212 that can be pushed against the panel 208 to form an end wall. In addition, another add-on panel 214 can be hingedly coupled to an outer edge 216 of the panel 212. The panel 214 can be folded against the stack of panels 210, 212, and the resulting structure 200 will resemble a four-sided structure that can be folded and collapsed using the same steps illustrated in FIGS. 5(A) through 5(E).

Figure 11:
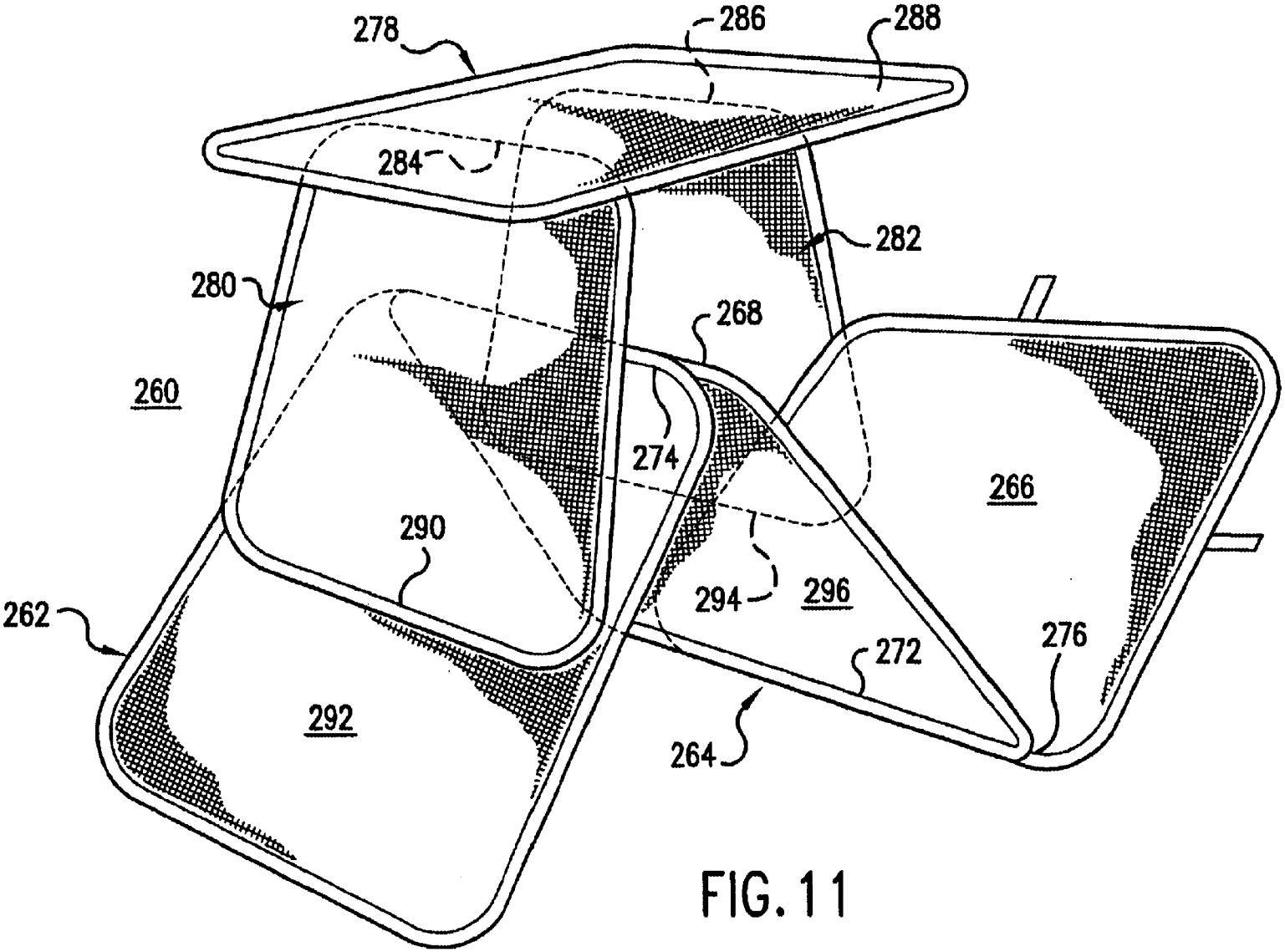
FIG. 11 is a perspective view of a collapsible structure according to another embodiment of the present invention.

FIG. 11 illustrates yet another structure 260 having a basic structure defined by three panels 262, 264, 266, each of which can have the same structure and construction as the panels 22*a*, 22*b*, 22*c* and 22*d* of structure 20. The opposing edges 268 and 272 of the panel 264 are hingedly connected to edges 274 and 276 of the panels 262 and 266, respectively. The panels 262, 264 and 266 are positioned to be angled with respect to each other and the ground so that panels 262 and 264 will be upright (but at an angle) as shown in FIG. 11. Panel 266 can be supported, for example, against a wall to provide sufficient support to maintain the panels 262 and 264 upright as shown in FIG. 11. Add-on panels 278, 280 and 282 can be assembled to be hingedly coupled to the panels 262, 264, 266. For example, the upper edges 284 and 286 of panels 280 and 282, respectively, can be stitched to the fabric 288 of the panel 278, the lower edge 290 of the panel 280 can be stitched to the fabric 292 of the panel 262, and the lower edge 294 of the panel 282 can be removably attached (e.g., by Velcro™ pads) to the fabric 296 of the panel 264.

Figure 12:
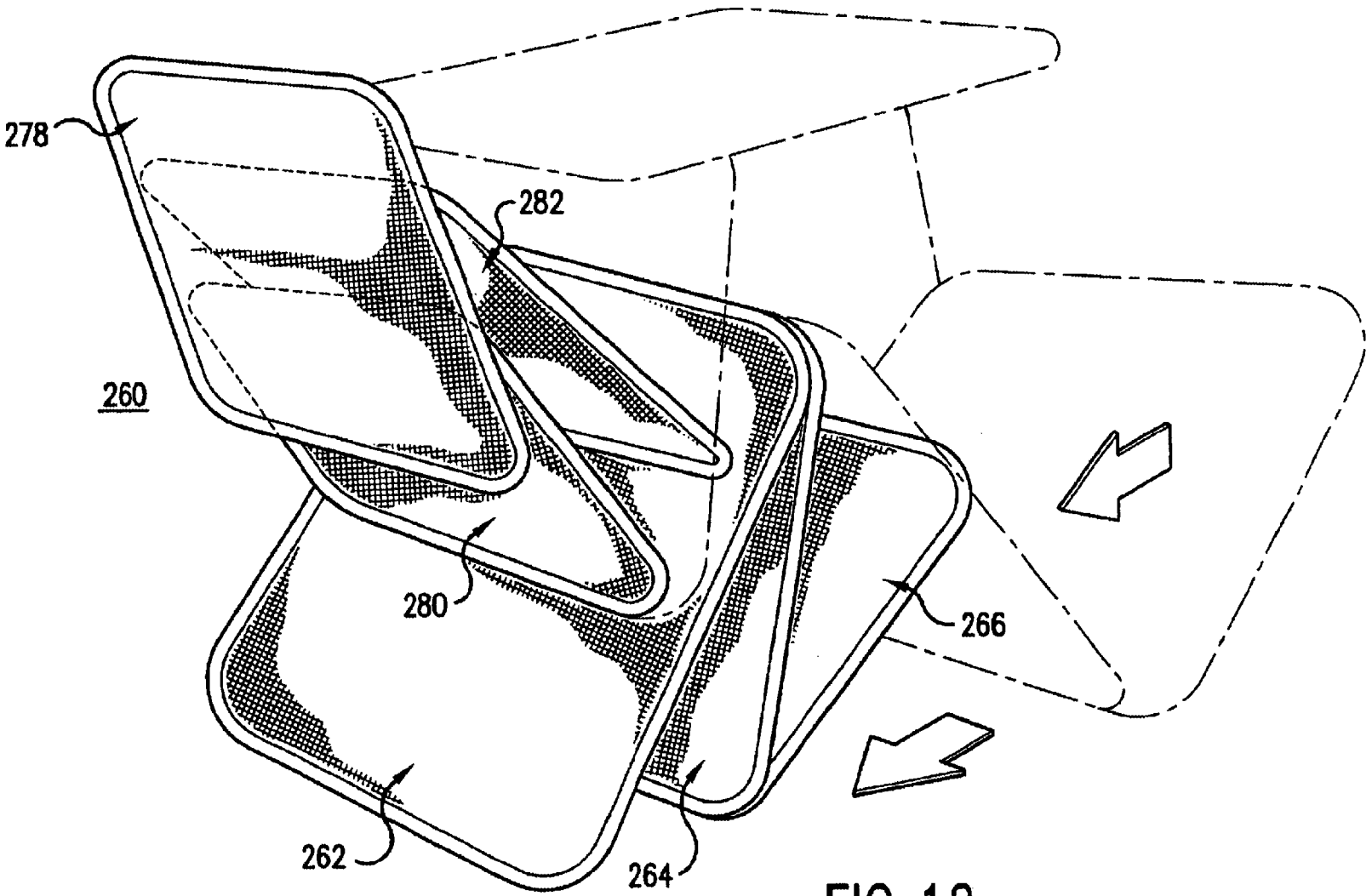
FIGS. 12 and 13 illustrate how the structure of FIG. 11 may be twisted and folded for compact storage.
Figure 13:
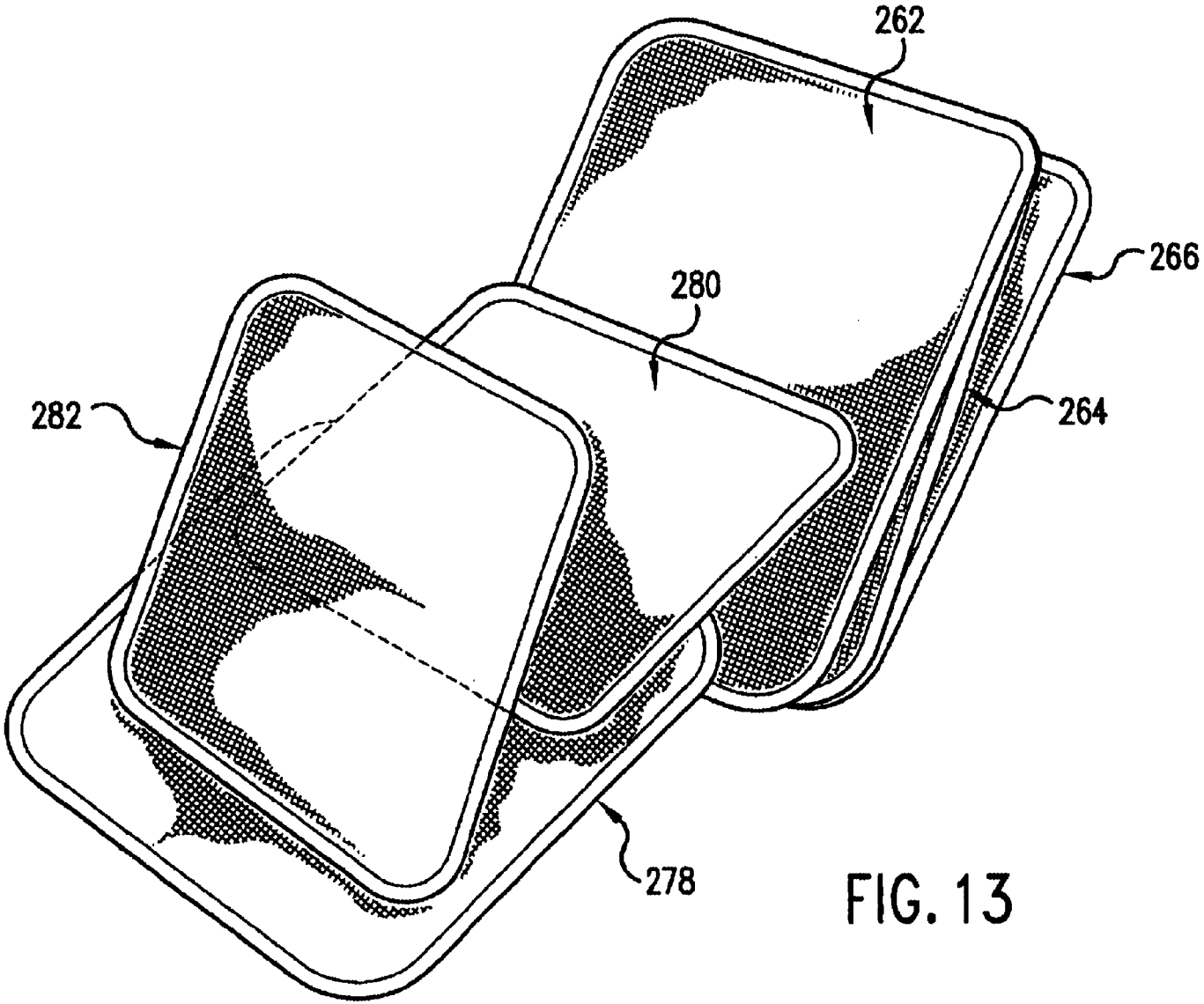

Referring now to FIGS. 12 and 13, the structure 260 can be collapsed into a smaller configuration by detaching the removable connection between the lower edge 294 of the panel 282 and the fabric 296 of the panel 264. Then, the add-on panels 282 and 278 can be folded against add-on panel 280 (see FIG. 12), and the panels 264 and 266 can be folded against the panel 262 (see FIG. 12) to form two stacks of three panels 278+280+282 and 262+264+266 (see FIG. 13). The two stacks of three panels 278+280+282 and 262+264+266 can be stacked together, and folded and collapsed using the steps illustrated in FIGS. 5(C) through 5(E).

FIGS. 14–18 illustrate how the principles of the present invention can be extended to a different type of collapsible structure having a base panel.

Figure 14:
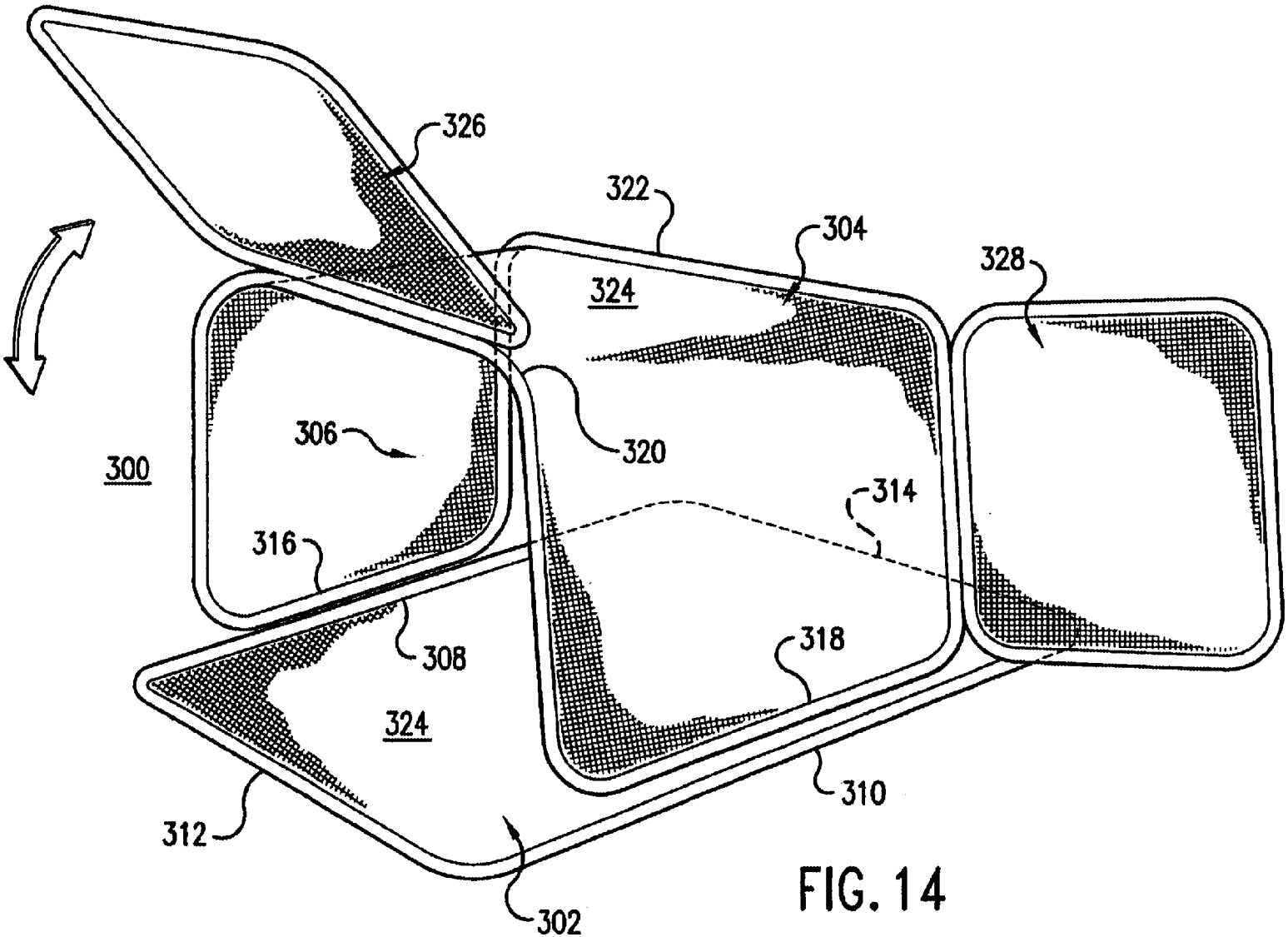
FIG. 14 is a perspective view of a collapsible structure according to yet another embodiment of the present invention.
Figure 15:
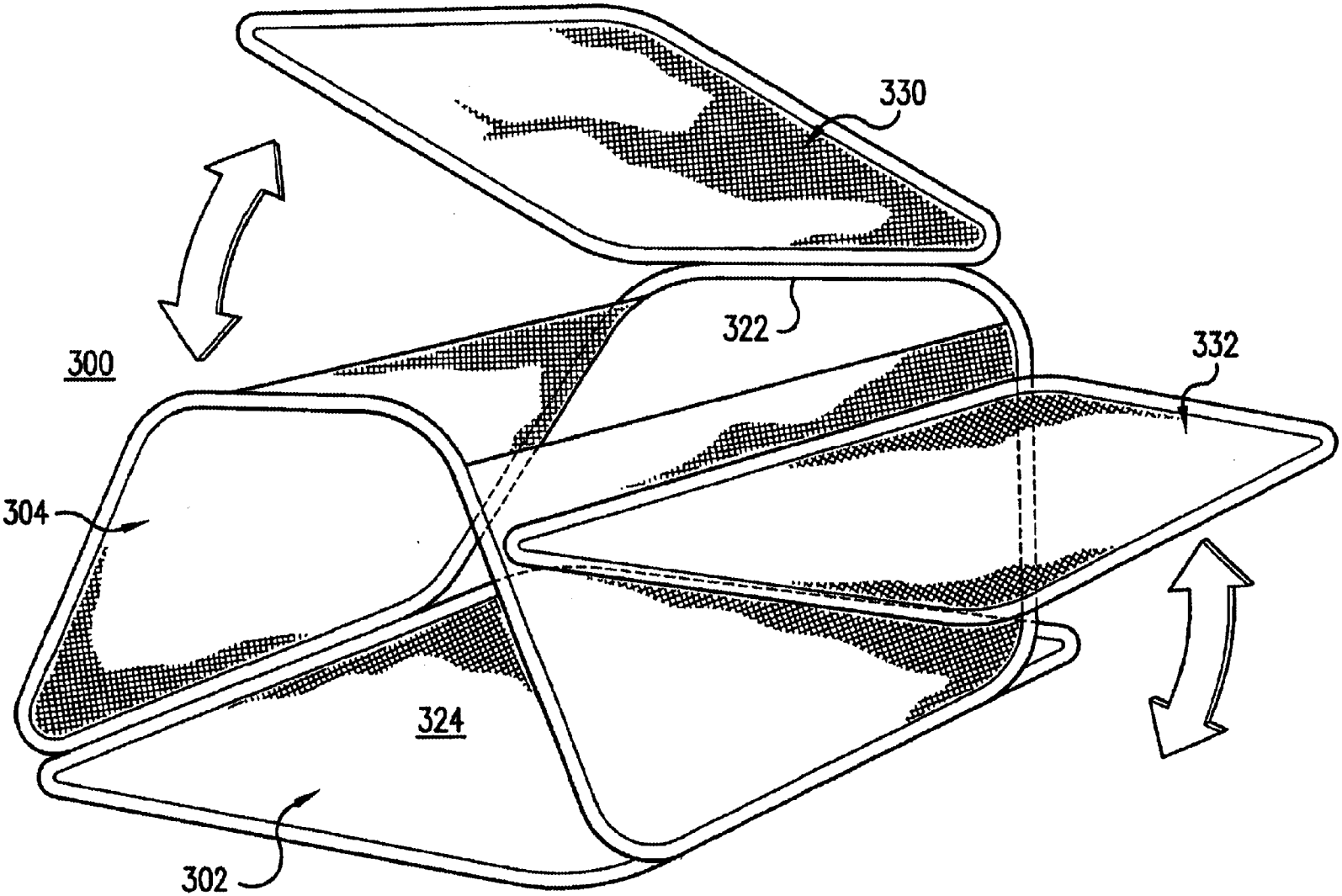
FIGS. 15, 16 and 18 illustrate modifications that can be made to the collapsible structure of FIG. 14.
Figure 16:
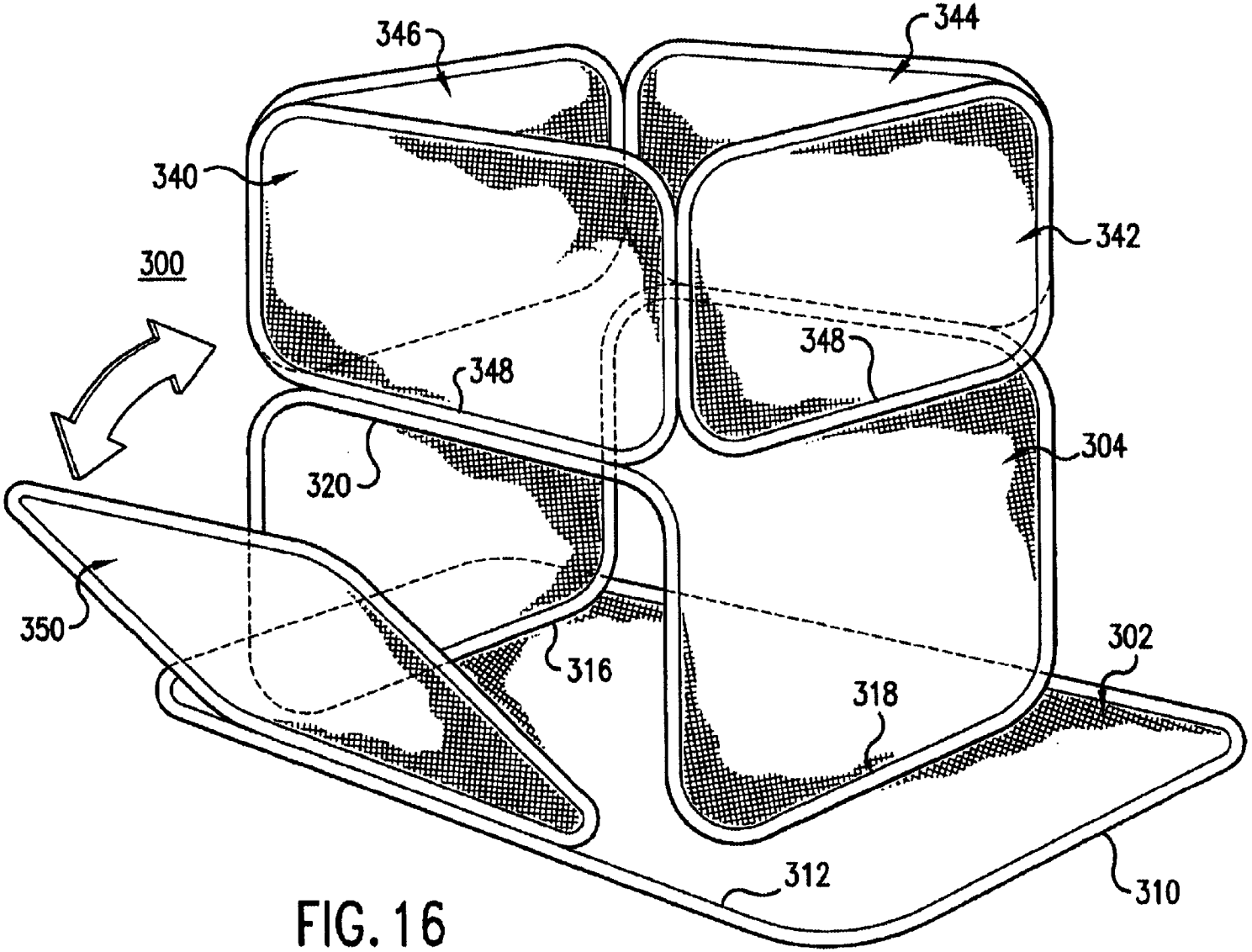

FIG. 14 illustrates a collapsible structure 300 having two separate panels 302 and 304 that are coupled together to form an enclosed space 306. One panel 302 may be a base panel that is adapted to have one side resting on a ground or surface, and the other panel 304 may be a wall panel that spans and covers the enclosed space 306. The panel 302 has two opposing end edges 308 and 310, and two opposing side edges 312 and 314 that are connected to the end edges 308 and 310 to form a generally four-sided configuration. The panel 304 also has two opposing end edges 316 and 318, and two opposing side edges 320 and 322 that are connected to the end edges 316 and 318 to form a generally four-sided configuration that has been bent to form a U-shaped configuration. The end edges 308 and 310 of the panel 302 are coupled to the end edges 316 and 318, respectively, of the panel 304 via any number of known methods. For example, the end edges 308 and 310 can be directly stitched to the end edges 316 and 318, respectively, as shown in FIGS. 14 and 15. Alternatively, the end edges 316 and 318 can be stitched to the fabric 324 of the base panel 302 at locations offset from the end edges 308 and 310 of the base panel 302, as shown in FIG. 16. As yet a further alternative, two interconnecting fabric pieces (not shown) can be stitched to the end edges 308, 310 and 316, 318 of the panels 302 and 304, respectively. Although illustrated as being generally four-sided in nature, the panels 302 and 304 can assume any configuration, such as circular, oval, rectangular, square, trapezoidal, or irregular.

As with the panels 22 described above, each panel 302, 304 has a continuous frame retaining sleeve provided along and traversing the edges of its sides. A continuous frame member (which can be the same as frame member 28) is retained or held within each frame retaining sleeve to support the respective panel 302, 304. Fabric or sheet material 324 (which can be the same as fabric 30) extends across each panel 302, 304 and is held taut by the respective frame members when each panel is in its open position.

Thus, the flexible and coilable nature of the frame members allows the wall panel 304 to be flexed so that its end edges 316 and 318 can be positioned at or adjacent the end edges 308 and 310 of the base panel 302. In this regard, the flexing of the wall panel 304 obviates the need to otherwise provide a plurality (e.g., at least three) of separate panels to enclose the space 306. The base panel 302 functions to hold the wall panel 304 in its flexed configuration.

Add-on panels 326 and 328 can be added to the basic structure defined by the panels 302, 304. For example, a first add-on panel 326 can be hingedly connected to the central portion of the edge 320 of panel 304, and can be used as a pivoting end door. A second add-on panel 328 can be hingedly connected to a side of the edge 322 of panel 304, and can also be used as another pivoting end door.

The structure 300 can be folded and collapsed in the following manner. First, the add-on panels 326 and 328 are pivoted against the wall panel 304 to overlie portions of the wall panel 304. For example, add-on panel 326 is pivoted upwardly to lie over the top of the wall panel 304. Then, the base panel 302 is pushed against the wall panel 304 (and the add-on panels 326, 328 that are stacked therewith) to form one stack of panels 302, 304, 326, 328 that can be twisted and folded in accordance with the steps shown in FIGS. 5C through 5E.

FIG. 15 illustrates certain modifications that can be made to the structure 300 shown in FIG. 14. The add-on panels 326 and 328 are replaced by two different add-on panels 330 and 332. For example, the add-on panel 330 can be hingedly connected to the central portion of the edge 322 of panel 304, and can be pivoted to cover the top of the panel 304. In this regard, the fabric 324 at the top (i.e., center) of the panel 304 is omitted, so that the top of the structure 300 is opened. As a result, the add-on panel 330 can act as a pivoting roof. Another add-on panel 332 can be hingedly connected (e.g., by stitching) to the fabric 324 of the panel 304 along one side, and can be pivoted up and down to form a side awning that provides shade to people seated underneath. Therefore, the structure 300 in FIG. 15 can be a large tent having a pivoting roof panel 330, and a pivoting awning panel 332.

FIG. 16 illustrates further modifications that can be made to the structure 300 shown in FIG. 14. First, an add-on ring of panels 340, 342, 344 and 346 is provided. This ring of panels 340, 342, 344 and 346 can have essentially the same structure and construction, and are hingedly connected to each other in the same manner, as the panels 22*a*, 22*b*, 22*c* and 22*d* of structure 20. The lower edge 348 of one panel 340 can be stitched to the center of edge 320 of the wall panel 304, and the lower edges 348 of the other add-on panels 342, 344, 346 are not connected to the wall panel 304. Instead, each of the lower edges 348 of the other add-on panels 342, 344, 346 are rested on top of the wall panel 304. Thus, the ring of panels 340, 342, 344 and 346 can be used to define another enclosure above the roof defined by the wall panel 304. In addition, another add-on panel 350 can be hingedly connected to the edge 312 of panel 302, and can also be used as a pivoting end door.

Figure 17:
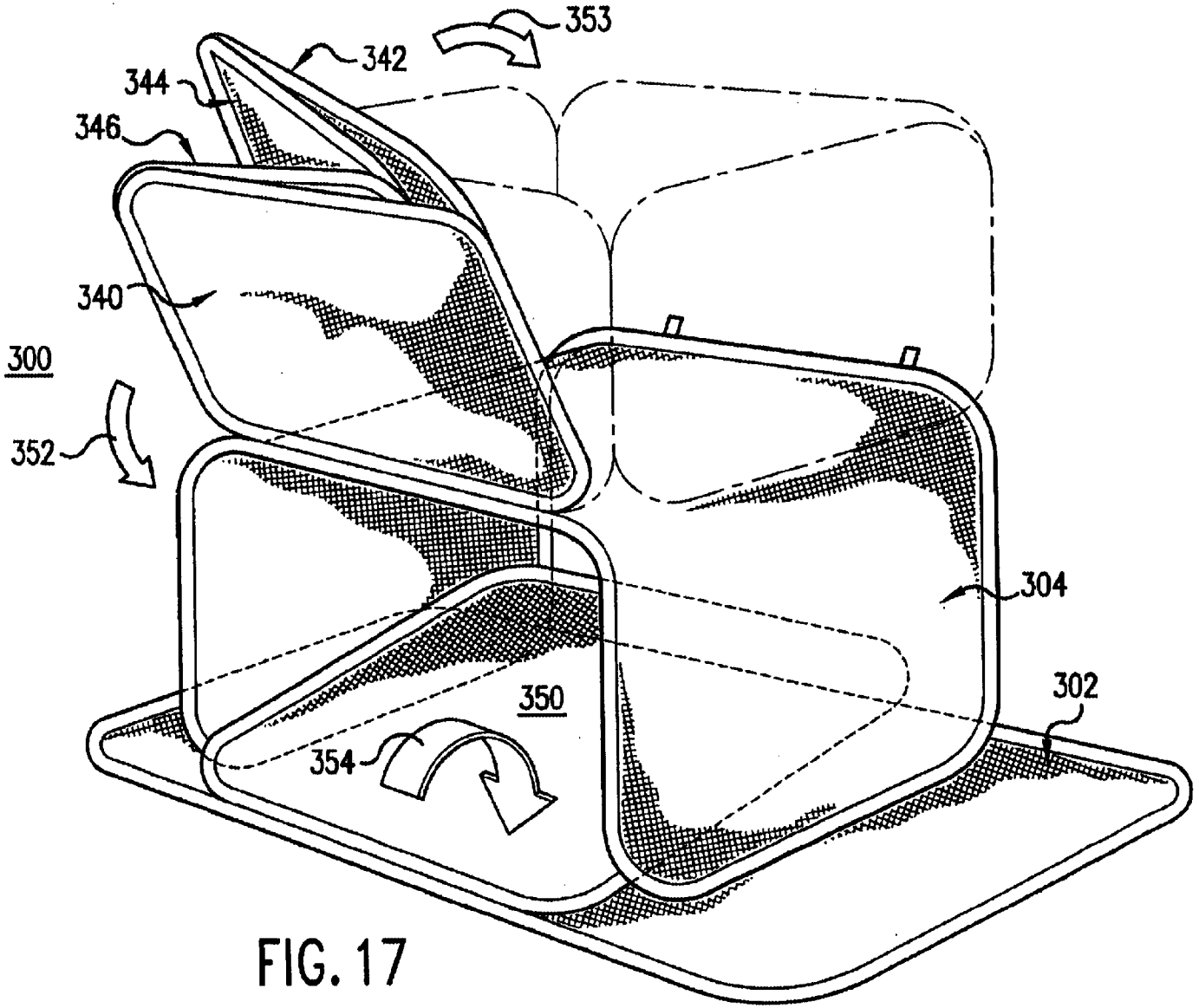
FIG. 17 illustrates how the structure of FIG. 16 may be twisted and folded for compact storage.

FIG. 17 illustrates how the structure 300 can be collapsed for storage. First, the ring of panels 340, 342, 344 and 346 is folded in the manner shown in FIGS. 5A and 5B to create a stack of four panels 340, 342, 344 and 346 that can be pivoted against the interior of the wall panel 304 (see arrow 352), or on top of the wall panel 304 (see arrow 353) to form a stack of five panels 304, 340, 342, 344 and 346. The add-on panel 350 is then pivoted against the interior of the base panel 302 (see arrow 354). The base panel 302 (and the add-on panel 350) is then pushed against the top panel 304 (and the add-on panels 340, 342, 344 and 346 that are stacked therewith) to form one stack of panels that can be twisted and folded in accordance with the steps shown in FIGS. 5C through 5E.

Figure 18:
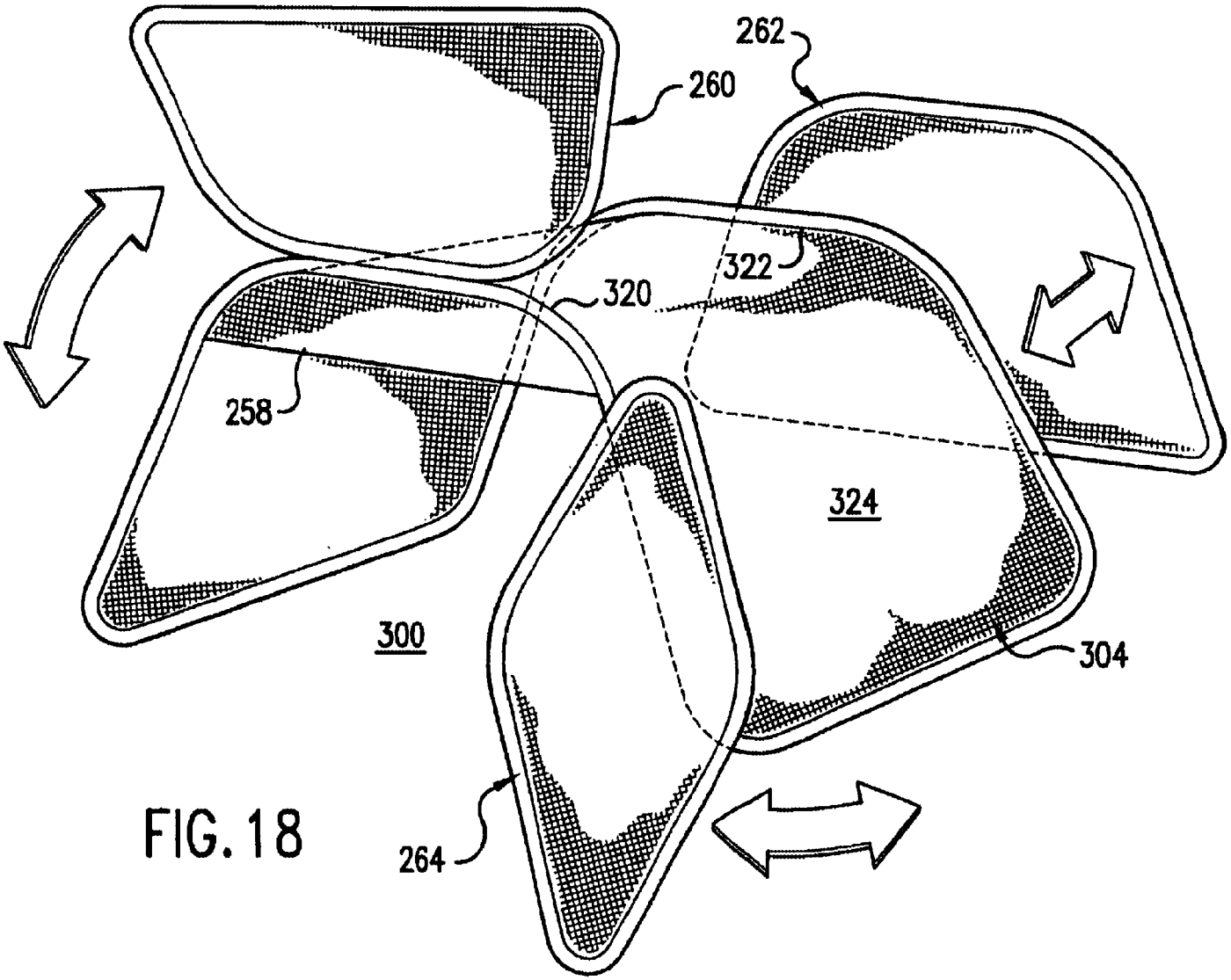

FIG. 18 illustrates yet another possible modification to the structure 300 of FIG. 14. In FIG. 18, the base panel 302 has been omitted, and a fabric piece 258 is stitched to a central portion of the edge 320 of the panel 304 to form the desired curved configuration for the panel 304. A first add-on panel 260 can be hingedly coupled to the center portion of the edge 320 to act as a pivoting end door, a second add-on panel 262 can be removably attached (e.g., by Velcro™ pads) to the edge 322, and a third add-on panel 264 can be hingedly connected (e.g., by stitching) to the fabric 324 of the panel 304 along one side thereof.

Figure 19:
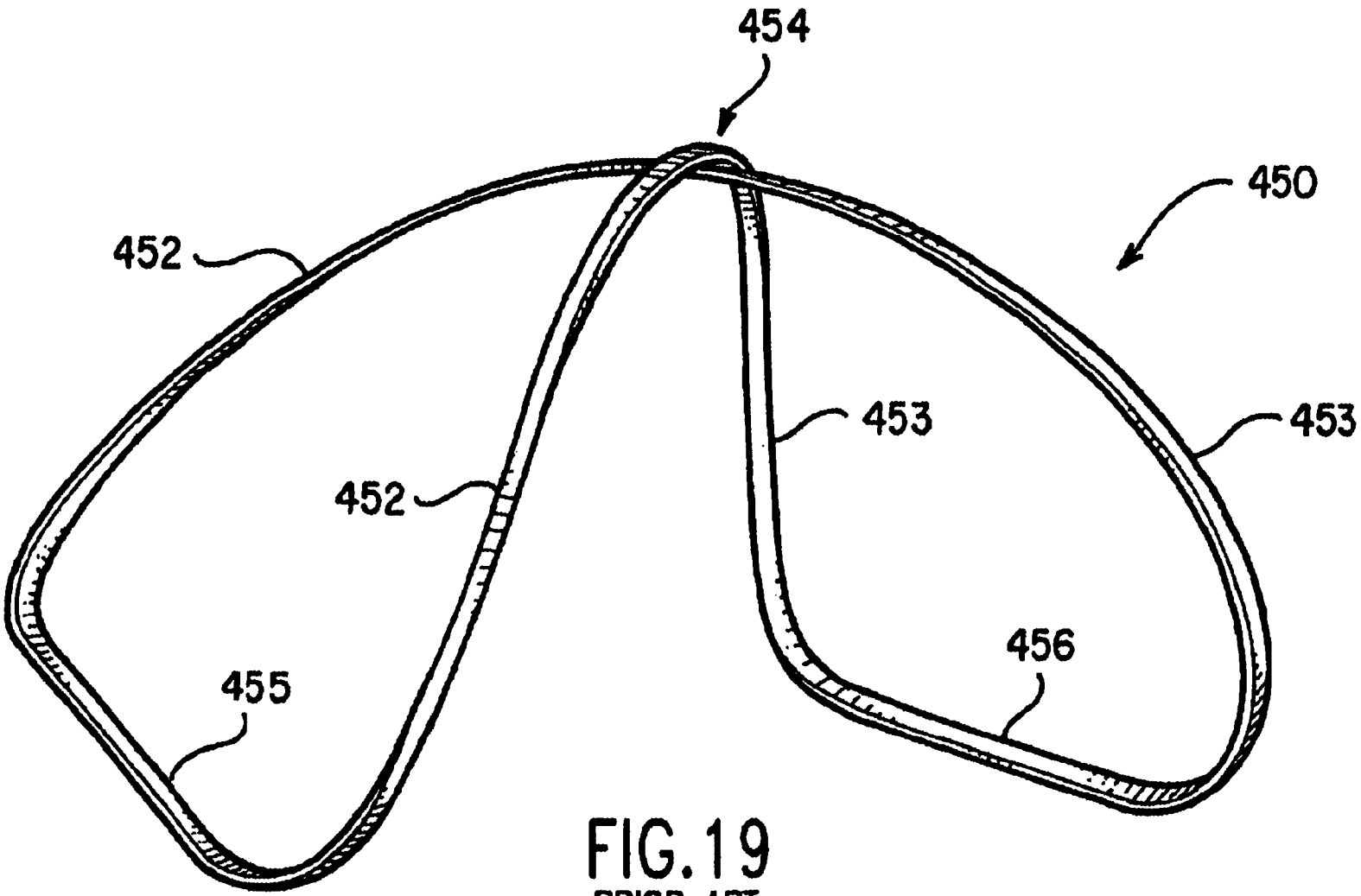
FIG. 19 PRIOR ART
FIG. 19 is a perspective view of the frame member for a conventional figure-eight collapsible structure.
Figure 20:
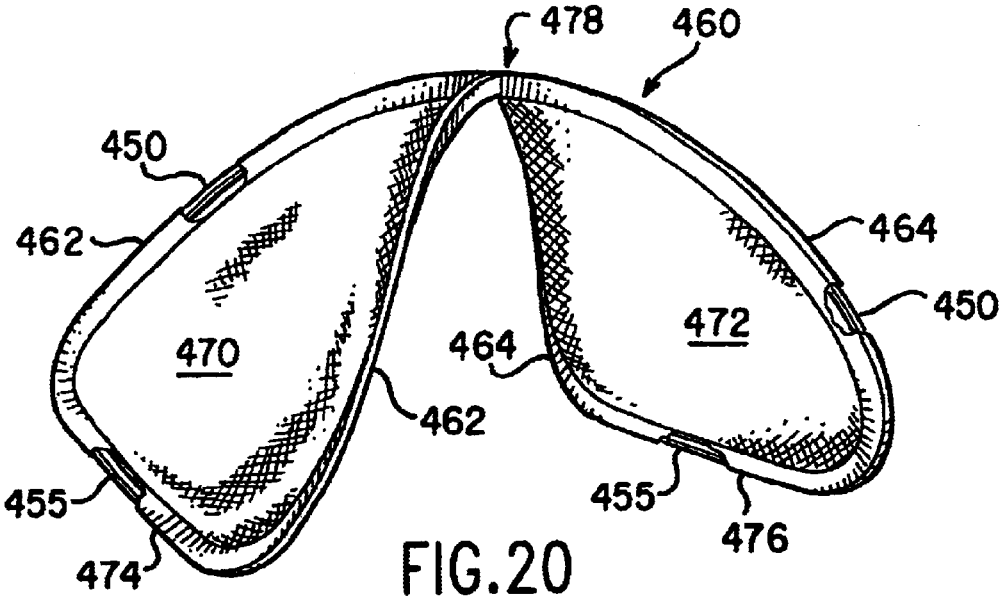
FIG.20 PRIOR ART
FIG. 20 is a perspective view of a conventional figure-eight collapsible structure incorporating the frame member of FIG. 19.

FIG. 20 illustrates a collapsible structure 460 that is made up of a single figure-eight frame member 450 shown in FIG. 19. FIGS. 19 and 20 correspond to FIGS. 1 and 2 of U.S. Pat. No. 4,825,892, whose entire disclosure is hereby incorporated by this reference as though fully set forth herein. The figure-eight configuration of the frame member 450 is characterized by a left loop 452 separated from a right loop 453 by a crossover point 454. The loops 452 and 453 have straight portions 455 and 456, respectively, for resting on a flat surface when the structure 460 is in the configuration shown in FIGS. 19 and 20. The frame member 450 can be formed from any of the materials used for the frame members 28 above. The figure-eight configuration shown in FIGS. 19 and 20 can be formed by a single 360 degree twist of the frame member 450.

Figure 21:
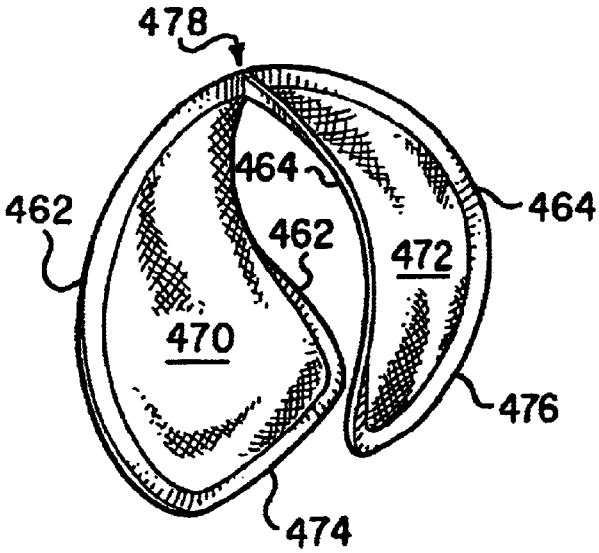
FIG.21 PRIOR ART
FIGS. 21–23 illustrate how the collapsible structure of FIG. 20 may be twisted and folded for compact storage.
Figure 22:
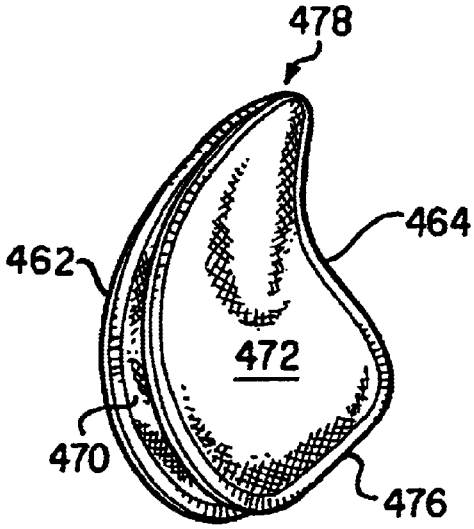
FIG.22 PRIOR ART
Figure 23:
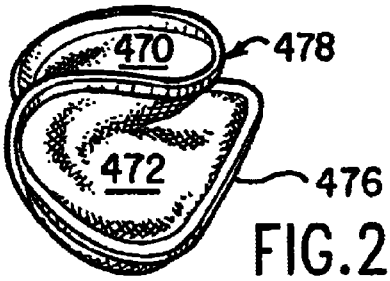
FIG.23 PRIOR ART

The structure 460 has left and right frame retaining sleeves 462 and 464, respectively, which retain the frame member 450. The sleeves 462 and 464 also define straight portions 474 and 476, respectively to retain the straight portions 455 and 456, respectively. Fabric 470 and 472 can be stitched or otherwise attached to the sleeves 464 and 464, respectively. Referring to FIG. 21, the structure 460 can be folded and collapsed by pushing or deforming straight portions 474, 476 towards each other. In FIG. 22, the two large loops 452 and 453 are deformed so that they overlie each other and crossover 478 is partly bent towards straight portion 476. In FIG. 23, crossover 478 is further bent towards straight portion 476, and then the steps in FIGS. 5D and SE can be applied to complete the twisting and folding. FIGS. 21–23 correspond to FIGS. 5–7 of U.S. Pat. No. 4,825,892.

Figure 24:
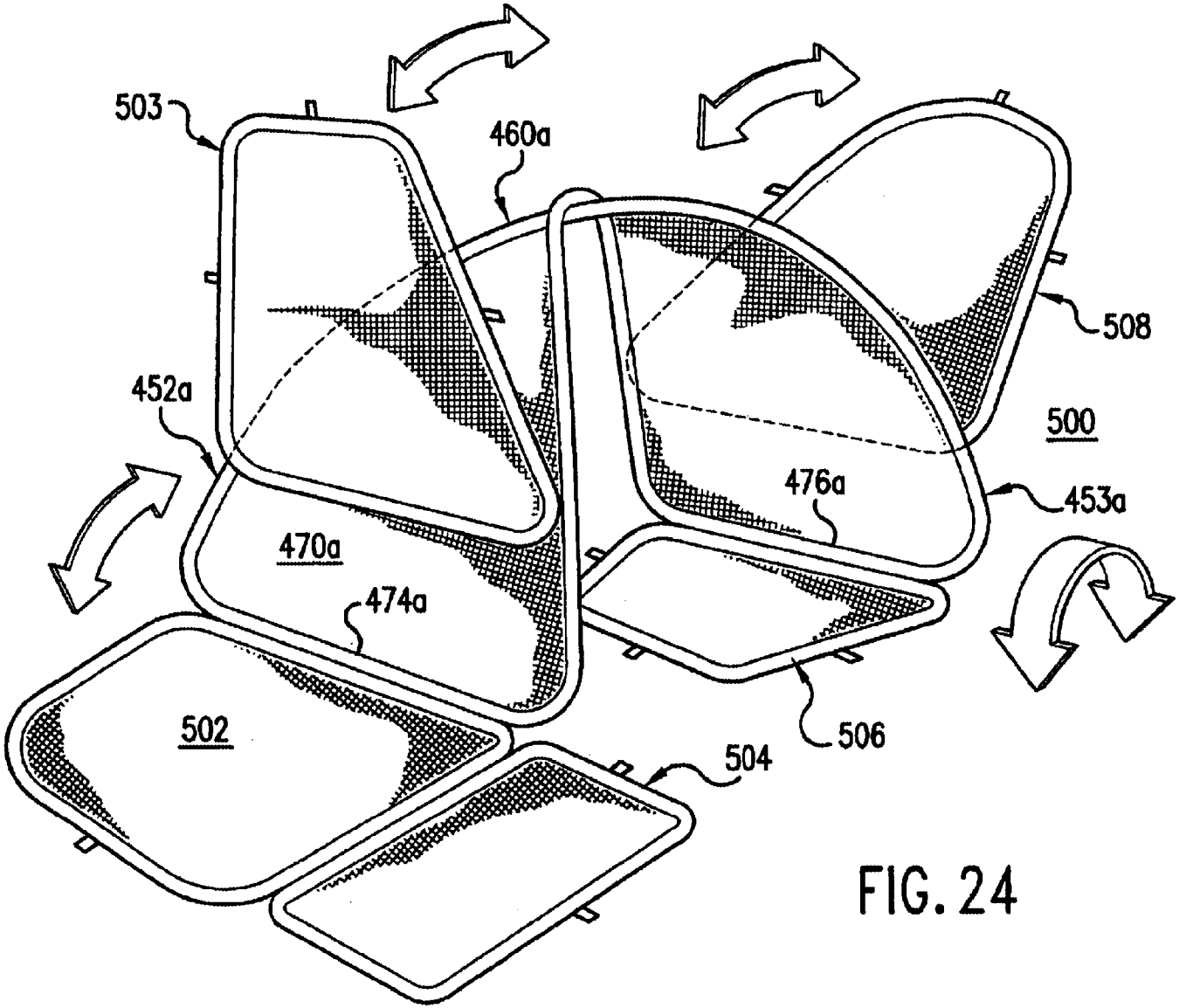
FIG. 24 is a perspective view of a collapsible structure according to another embodiment of the present invention.
Figure 25:
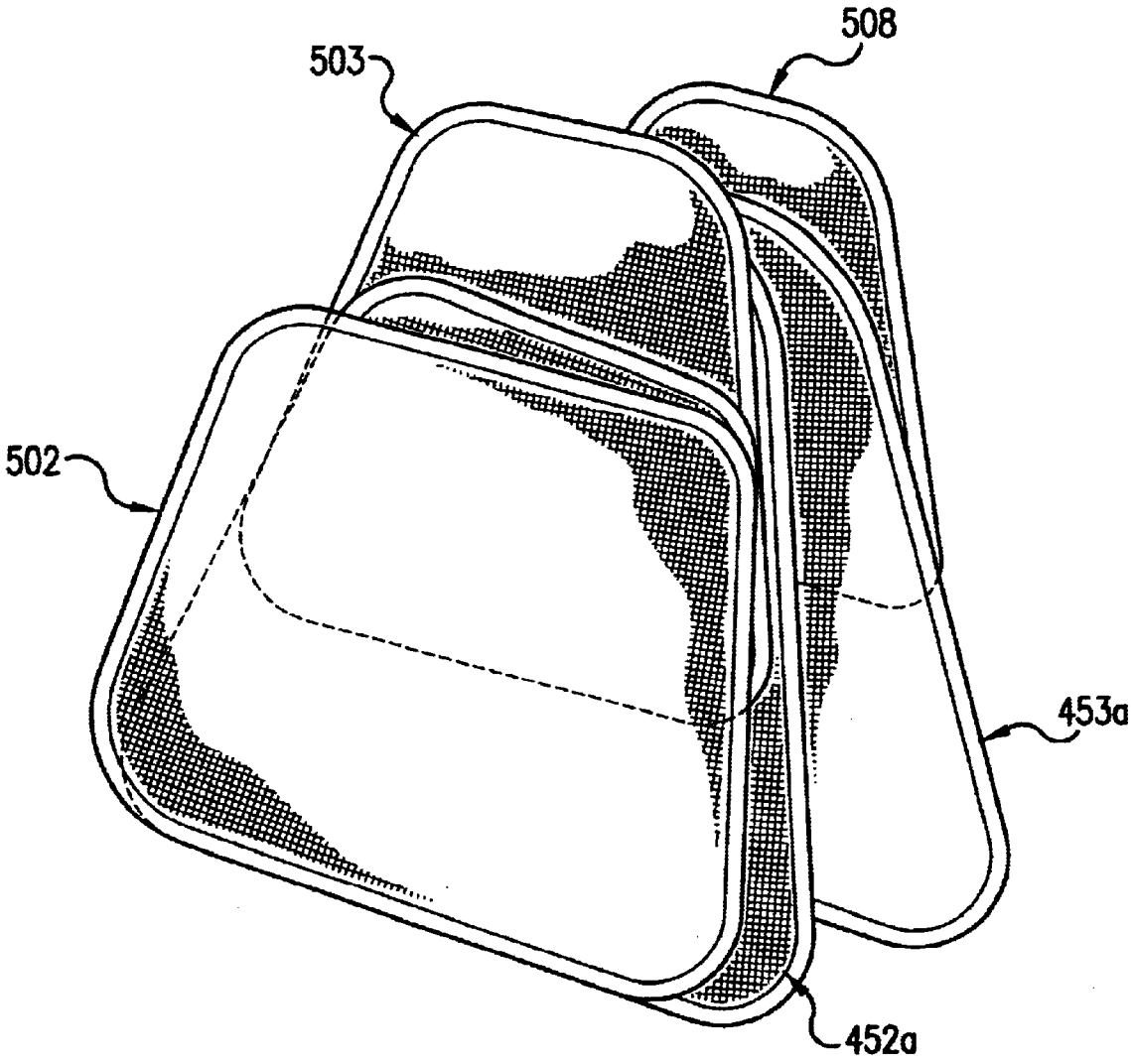
FIG. 25 illustrates how the collapsible structure of FIG. 24 may be twisted and folded for compact storage.

FIGS. 24–29 illustrate how the principles of the present invention can be extended to the figure-eight structures of FIGS. 19 and 20. For example, FIG. 24 illustrates a structure 500 that has an underlying figure-eight structure 460*a* that is the same as the structure 460 in FIG. 20. A first add-on panel 502 can be hingedly coupled to the straight portion 474*a*, a second add-on panel 503 can be hingedly connected (e.g., by stitching) to the fabric 470*a* of the loop 452*a* along one side, and can be pivoted up and down to act as an awning, a third add-on panel 504 can be hingedly coupled to an edge of the first add-on panel 502, a fourth add-on panel 506 can be hingedly coupled to the straight portion 476*a*, and a fifth add-on panel 508 can be removably attached (e.g., by Velcro™ pads) to the loop 453*a*. In this regard, the loop 453*a* can be devoid of fabric so that the fifth add-on panel 508 functions as a wall or door.

The structure 500 in FIG. 24 can be folded and collapsed by first folding the add-on panels 502, 503, 504 against each other and against the loop 452*a*, and then folding or pushing the add-on panels 506, 508 against each other and against the loop 453*a* (see FIG. 25), and then following the steps illustrated in FIGS. 23, 5D and 5E.

Figure 26:
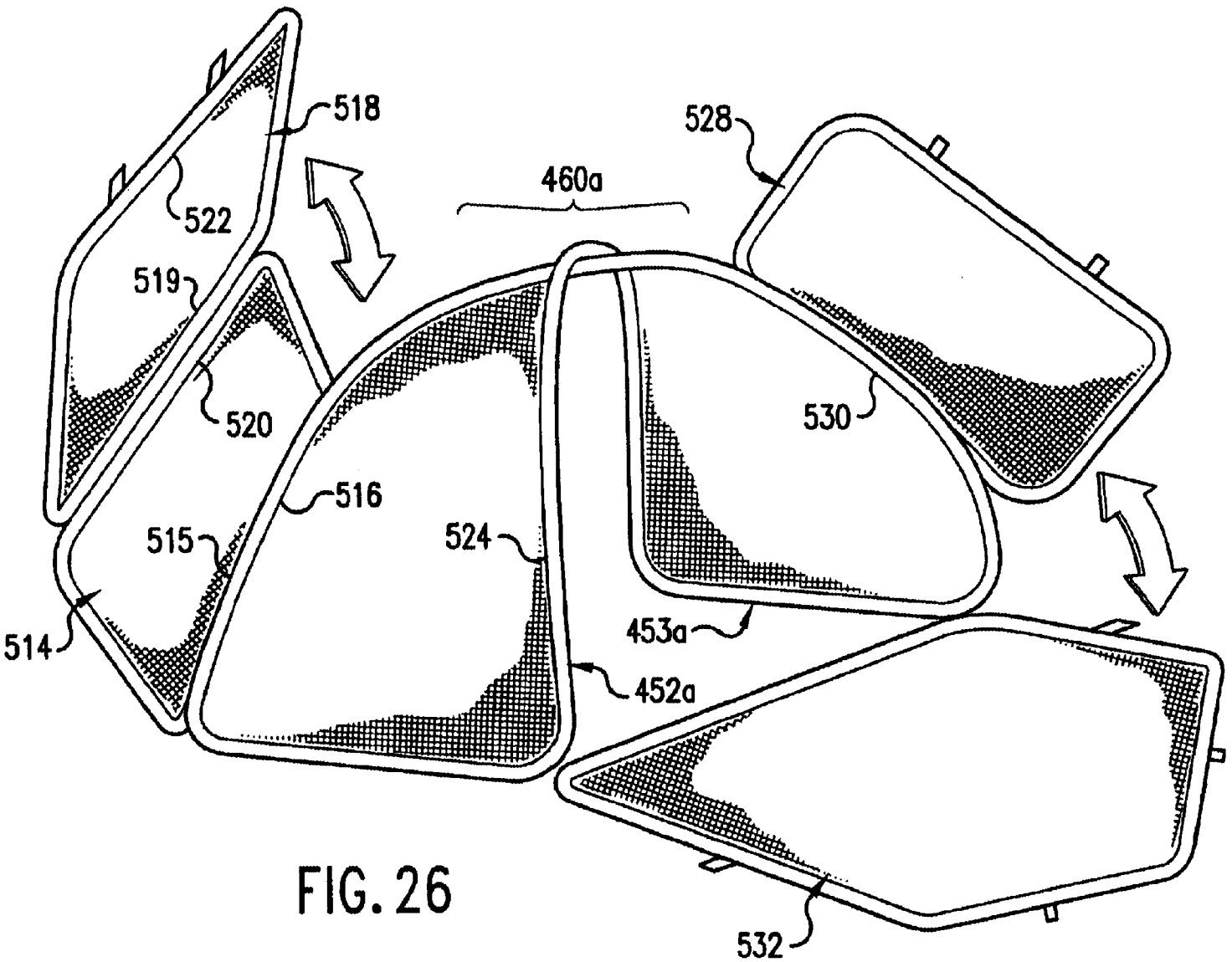
FIGS. 26 and 27 illustrate modifications that can be made to the collapsible structure of FIG. 24.

FIG. 26 illustrates certain modifications that can be made to the structure 500 shown in FIG. 24. The add-on panels 502, 503, 504, 506 and 508 are replaced by other add-on panels. For example, a first add-on panel 514 can be hingedly coupled along a first side 515 to a first side 516 of the loop 452*a*, and a second add-on panel 518 can be hingedly connected (e.g., by stitching) along a first side 519 to a second side 520 of the panel 514. The second side 522 of the panel 518 can be removably attached (e.g., by Velcro™ pads) to a second side 524 of the loop 452*a*. Thus, the add-on panels 514 and 518 define an enclosure (i.e., like a hinged window) for the loon 452*a*. The combined width of the add-on panels 514 and 518 can be the same as the width of the loop 452*a*, in which case the add-on panels 514 and 518 define a flat hinged window. Alternatively, the combined width of the add-on panels 514 and 518 can be larger than the width of the loop 452*a*, in which case the add-on panels 514 and 518 define a V-shaped hinged window where the base (i.e., hinged connection at sides 519 and 520) extends away from the loop 452*a* and the panels 514 and 518 are angled with respect to the loop 452*a*.

In addition, a third add-on panel 528 can be hingedly coupled to a first side 530 of the loop 453*a*. A fourth add-on panel 532 can also be removably attached (e.g., by Velcro™ pads) to the sides 524 and 530 of the loops 452*a* and 453*a*, respectively, to define a removable wall or door.

Figure 27:
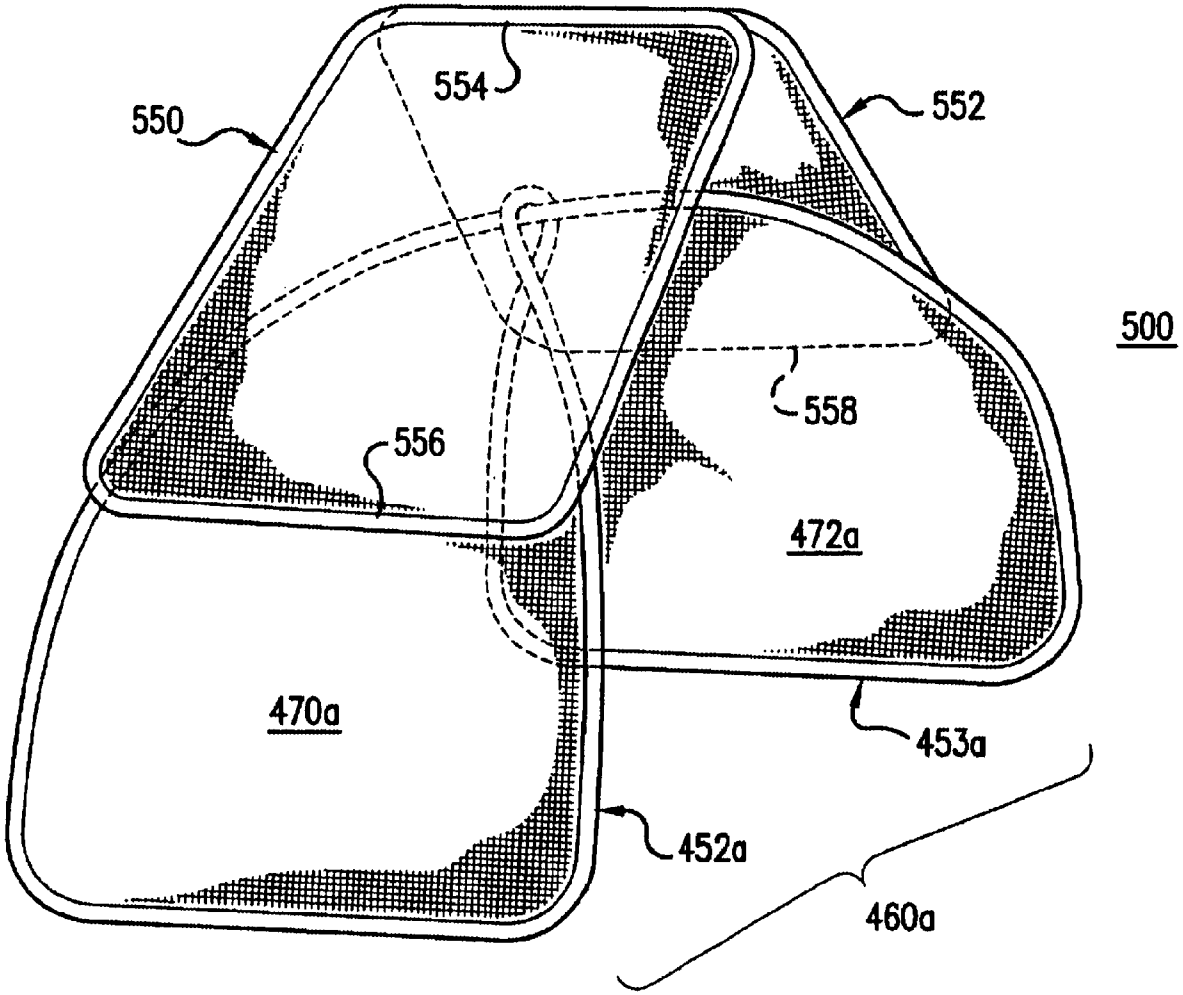

FIG. 27 illustrates other modifications that can be made to the structure 500 shown in FIG. 24. The add-on panels 502, 503, 504, 506 and 508 are replaced by a pair of add-on panels 550 and 552 that are hingedly coupled to each other along adjacent top edges (e.g., see edge 554). The bottom edge 556 of add-on panel 550 can be hingedly coupled to the fabric 470*a* of the loop 452*a*, and the bottom edge 558 of add-on panel 552 can be removably attached (e.g., by Velcro™ pads) to the fabric 472*a* of the loop 453*a*. The add-on panels 550 and 552 can be used as a top hut or roof cover for the underlying structure 460*a*.

Figure 28:
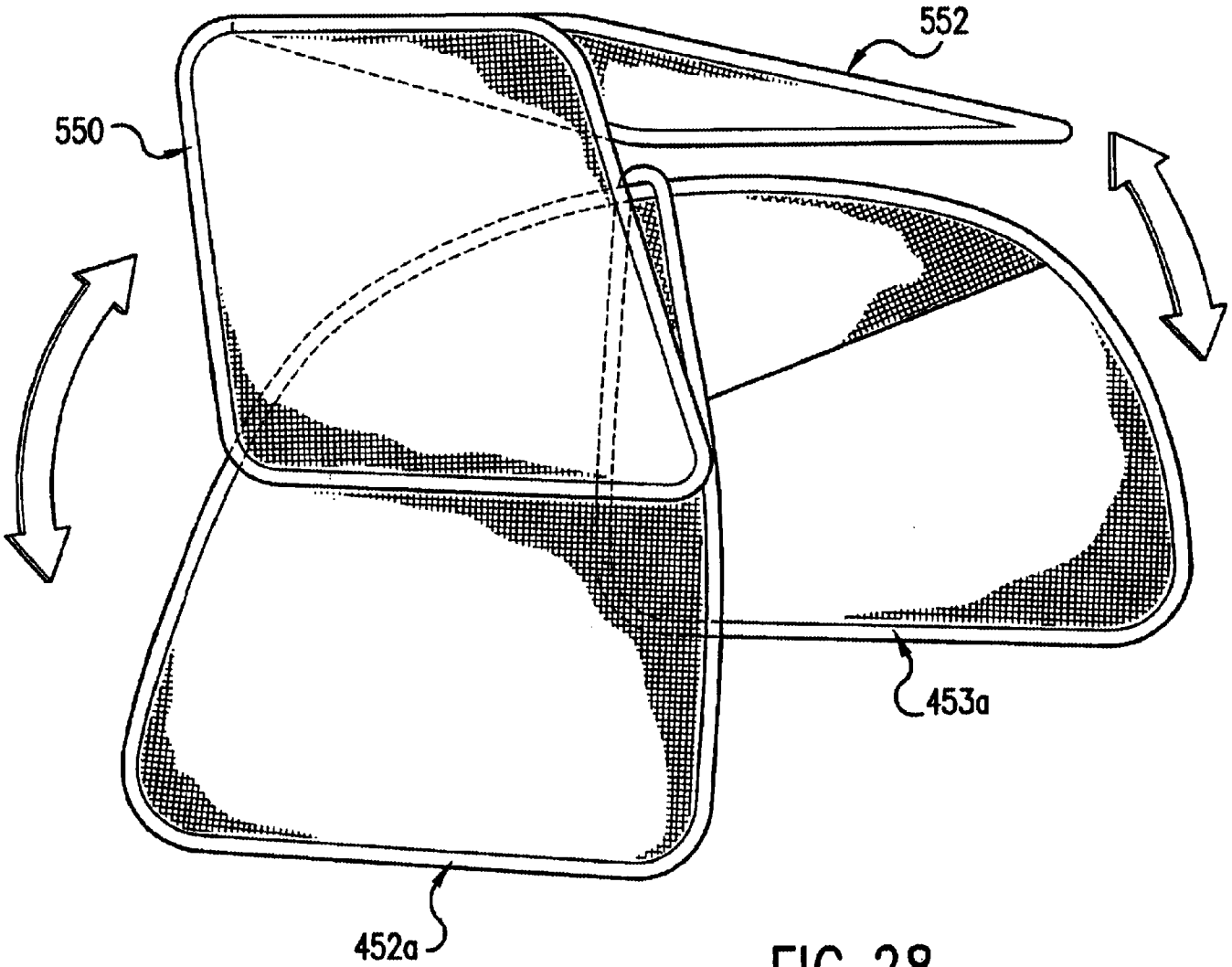
FIGS. 28–29 illustrate how the collapsible structure of FIG. 27 may be twisted and folded for compact storage.
Figure 29:
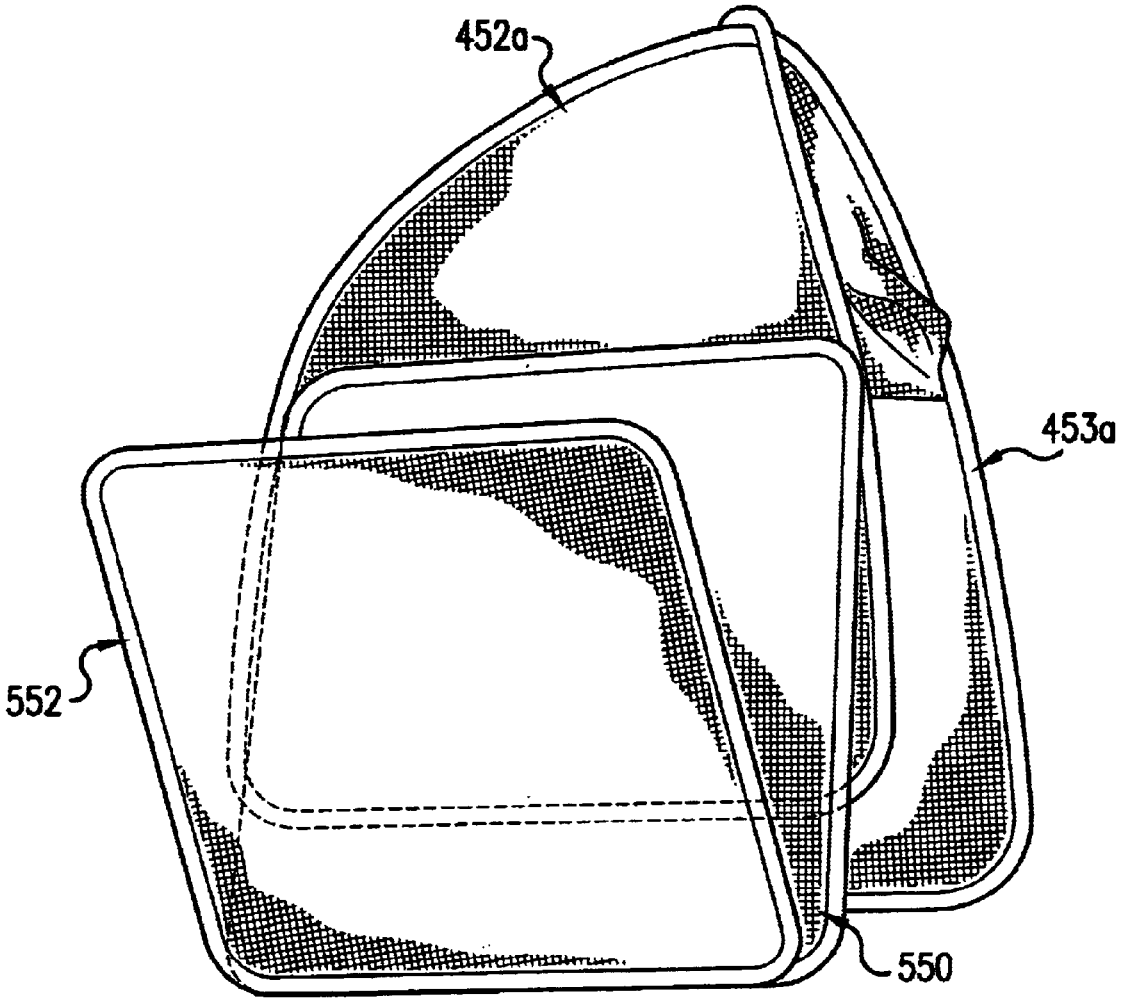

The structure 500 in FIG. 27 can be folded and collapsed by first detaching the connection at the bottom edge 558 of the panel 552, and then folding the add-on panels 550, 552 against each other (see FIG. 28). The panels 550, 552 are then folded against the loop 452*a* (see FIG. 29), and then the entire structure 500 is folded and collapsed according to the steps illustrated in FIGS. 23, 5D and 5E.

Figure 30:
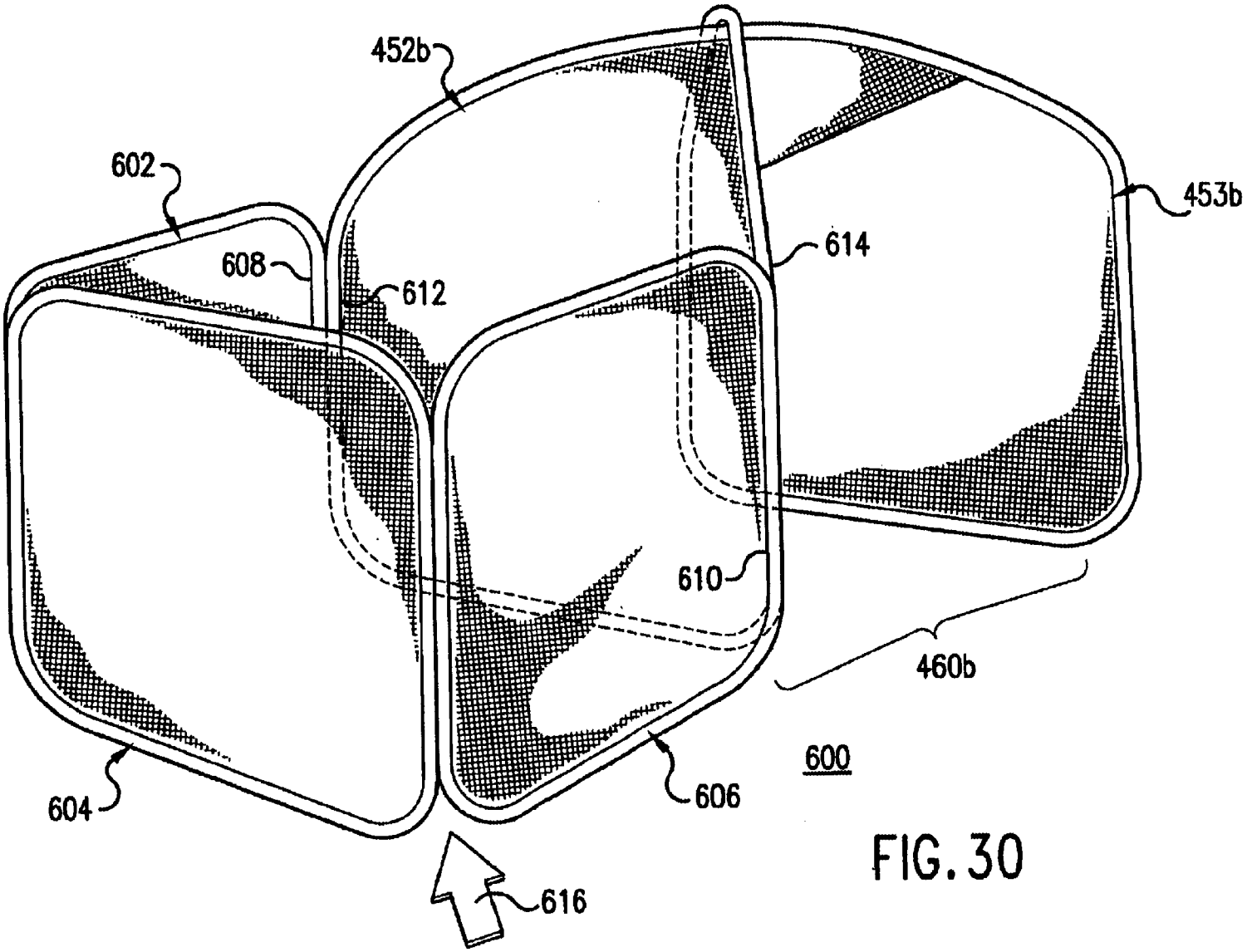
FIG. 30 is a perspective view of a collapsible structure according to another embodiment of the present invention.

Each of the underlying or basic structures illustrated in FIGS. 1, 14 and 20 can be considered to be an "add-on" item and combined with other basic structures. For example, FIG. 30 illustrates a structure 600 that has an underlying figure-eight structure 460*b* that is the same as the structure 460 in FIG. 20. Three add-on panels 602, 604, 606 are hingedly connected to form a ring of panels 602, 604, 606 that can have essentially the same structure and construction, and are hingedly connected to each other in the same manner, as three of the panels 22*a*, 22*b*, 22*c* and 22*d* of structure 20, except that the panels 602 and 606 each has a free side 608 and 610, respectively. The free side 608 of panel 602 is hingedly connected to one side 612 of the loop 452*b*, and the free side 610 of panel 606 is hingedly connected to another side 614 of the loop 452*b*.

Figure 31:
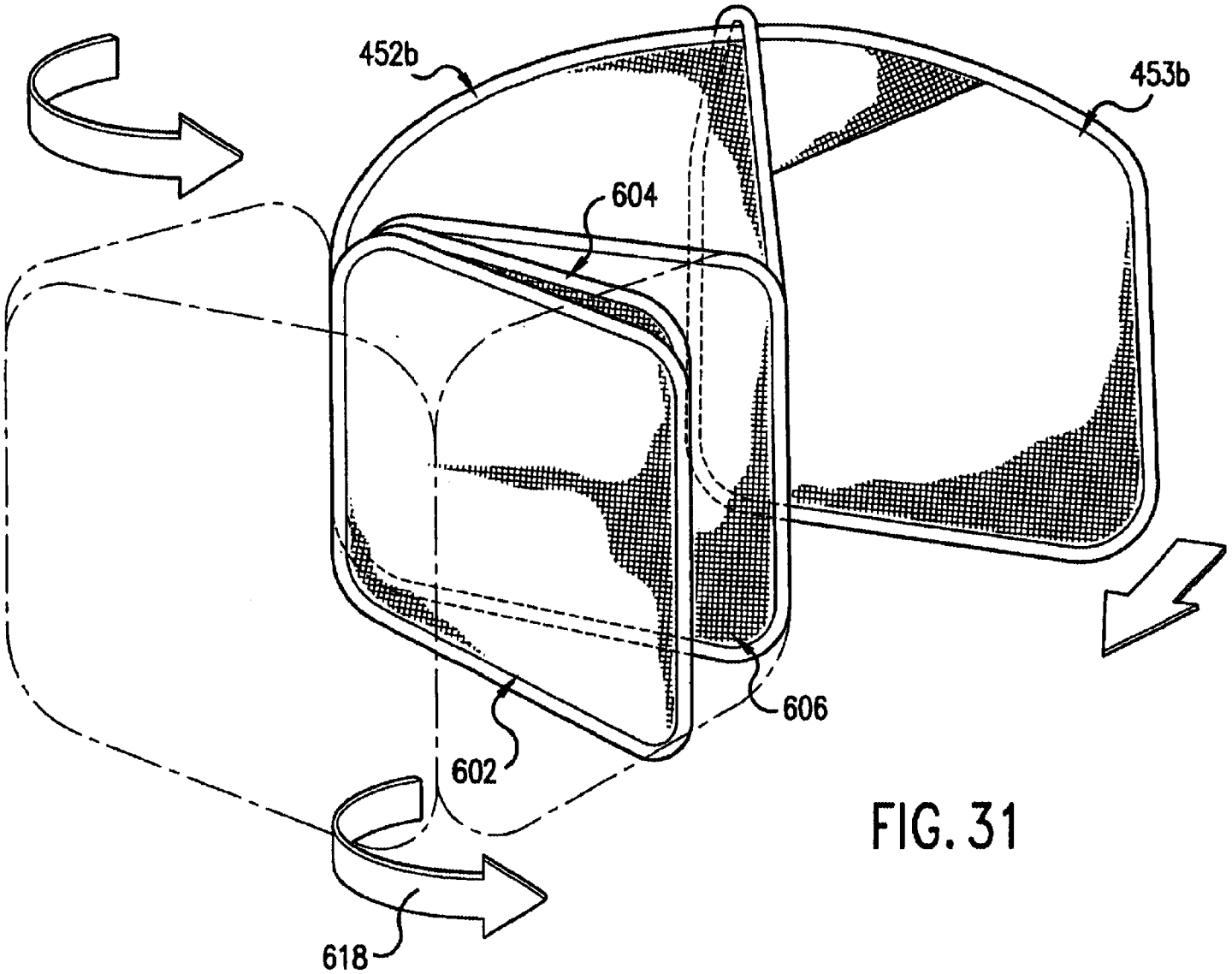
FIG. 31 illustrates how the collapsible structure of FIG. 30 may be twisted and folded for compact storage.

The structure 600 in FIG. 30 can be folded and collapsed by first pushing panels 604 and 606 inwardly against panel 602 and loop 452*b*, respectively (see arrow 616), and then pushing the stack of two panels 602 and 604 against the stack of panel 606 and loop 452*b* (see arrow 618 in FIG. 31). The structure 600 can then be folded and collapsed according to the steps illustrated in FIGS. 21–23.

FIG. 32 illustrates another example of how the principles of the present invention can be used to increase the amusement and utility of existing collapsible structures. In FIG. 32, the structure 700 has four panels 702, 704, 706, 708 that have essentially the same structure and construction, and are hingedly connected to each other in the same manner, as the panels 22*a*, 22*b*, 22*c* and 22*d* of structure 20. The only difference is that the shapes of the panel 702 is shorter in height than the other panels 704, 706, 708, and the panel 706 is greater in height than the other panels 702, 704, 708. In addition, fabric can be omitted from the panel 702, so that the panel 702 essentially forms a large opening. Two add-on panels 710 and 712 can be added. A first add-on panel 710 can have the same shape and size as the panel 706, and has a bottom side 714 that can be hingedly connected to the bottom side 716 of the panel 702. A second add-on panel 712 can have the same shape and size as the panel 702, and be provided without any fabric to form a large opening, and has a bottom side 718 that can also be hingedly connected to the bottom side 716 of the panel 702. A first netting or fabric 720 can be stitched to the sides of the panels 702 and 712 to form a tunnel between the panels 702 and 712, and fabric or netting pieces 722 and 724 can be stitched to the sides of the panels 710 and 712 so that the panel 710 defines a ramp extending from the tunnel.

A basket 726 can be attached to the inner surface of the fabric 728 of the panel 706, and a fabric hook piece 730 can be stitched or connected to the top side 732 of the panel 706. Thus, the structure 700 can be suspended from a door hook (via the fabric hook piece 730) in the configuration shown in FIG. 32. A user can then toss a ball at the basket 726, and the ball is received inside the interior of the structure 700 defined by the panels 702, 704, 706, 708, and then returned to the user via the ramp defined by the panel 710. In this regard, the fabric or netting pieces 720, 722 and 724 define the maximum angle and extent to which the panel 710 can be suspended with respect to the panel 702. When it is desired to pack up the structure 700 for storage, the panel 710 be pushed against the panels 712 and 702 to form a stack of three panels 702, 712 and 710. To secure the panel 710 against the panel 702, toggles (e.g., 740) provided on the sides (e.g., 742) of one panel (e.g., 704) can be slipped into loops (e.g., 744) provided on the panel 710, or opposing Velcro™ pads can be used. The resulting structure 700 will then have four sides and resemble the structure 20, at which point the structure 700 can be used in the same manner as structure 20, or twisted and folded according to the steps in FIGS. 5A through 5E.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure, comprising:

a first frame member that has a folded and an unfolded orientation, the first frame member having a figure-eight configuration when in the unfolded orientation, the figure-eight configuration defining a first loop, a second loop, and a crossover that forms the apex of the first frame member in the unfolded orientation and with the first and second loops extending downwardly from the apex;

a fabric material covering portions of the first frame member inside the first and second loops when the first frame member is in the unfolded orientation; and a flat panel coupled to the first loop, the panel having a foldable second frame member having a folded and an unfolded orientation, and a fabric material covering portions of the second frame member, the flat panel further including a side edge that is stitched to the fabric material of the first loop at a location extending within and spaced-apart from the first frame member;

wherein the second frame member is twisted and folded to form a plurality of concentric frame members when the frame member is in the folded orientation.

2. The structure of claim 1, wherein each of the first and second loops has a straight portion opposite the crossover, each straight portion resting on a surface.

3. The structure of claims 2, wherein the flat panel is a first panel, further including a second panel coupled to the straight portion of the second loop, the second panel having a foldable frame member having a folded and an unfolded orientation, and a fabric material covering portions of the frame member for the second panel.

4. The structure of claim 1, wherein the flat panel is a first panel, further including a second panel coupled to the first panel, the second panel having a foldable frame member having a folded and an unfolded orientation, and a fabric material covering portions of the frame member for the second panel.

5. The structure of claim 4, wherein the second panel is also coupled to the second loop.

6. The structure of claim 1, wherein the flat panel is separate from the first frame member.

7. The structure of claim 1, wherein the second frame member defines the shape of the flat panel.

8. A collapsible structure, comprising:

a frame member that has a folded and an unfolded orientation, the frame member having a figure-eight configuration when in the unfolded orientation, the figure-eight configuration defining a first loop, a second loop, and a crossover that forms the apex of the frame member in the unfolded orientation and with the first and second loops extending downwardly from the apex;

a fabric material covering portions of the frame member inside the first and second loops when the frame member is in the unfolded orientation; and first, second and third panels, each panel having a foldable frame member having a folded and an unfolded orientation, and a fabric material covering portions of the frame member for the respective panel, with each panel having a first side and a second side, and with the first side of the first panel coupled to the first loop, the second side of the first panel coupled to the first side of the second panel, the second side of the second panel coupled to the first side of the third panel, and the second side of the third panel coupled to the first loop.

9. The structure of claim 8, wherein each of the first and second loops has a straight portion opposite the crossover, each straight portion resting on a surface.

* * * * *